US007221882B2

(12) United States Patent
Nakagawa

(10) Patent No.: US 7,221,882 B2
(45) Date of Patent: May 22, 2007

(54) IMAGE FORMING APPARATUS AND IMAGE FORMATION CONTROL METHOD IN THE SAME

(75) Inventor: Ken Nakagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 11/014,784

(22) Filed: Dec. 20, 2004

(65) Prior Publication Data

US 2005/0135822 A1 Jun. 23, 2005

(30) Foreign Application Priority Data

Dec. 22, 2003 (JP) ..... 2003-425825

(51) Int. Cl.
*G03G 15/00* (2006.01)

(52) U.S. Cl. ..... 399/49; 399/72

(58) Field of Classification Search ..... 399/49, 399/72, 51, 53, 55, 59, 60, 66, 27, 40
See application file for complete search history.

(56) References Cited

U.S. PATENT DOCUMENTS

| | | | | |
|---|---|---|---|---|
| 5,579,090 | A | 11/1996 | Sasanuma et al. | 355/208 |
| 6,044,234 | A * | 3/2000 | Yoshizawa | 399/49 |
| 6,061,533 | A * | 5/2000 | Kajiwara | 399/49 |
| 6,075,954 | A * | 6/2000 | Ogata et al. | 399/60 |
| 6,115,561 | A | 9/2000 | Fukushima | 399/49 |
| 6,686,943 | B2 * | 2/2004 | Ishii et al. | 347/133 |
| 6,937,826 | B2 * | 8/2005 | Yamamoto et al. | 399/49 |
| 2004/0105691 | A1 * | 6/2004 | Hama et al. | 399/49 |
| 2004/0113975 | A1 * | 6/2004 | Brookmire et al. | 347/40 |

FOREIGN PATENT DOCUMENTS

| | | |
|---|---|---|
| JP | 1-169567 | 4/1989 |
| JP | 7-209934 | 8/1995 |
| JP | 10-39555 | 2/1998 |
| JP | 11-119481 | 4/1999 |
| JP | 2002-139877 | 5/2002 |
| JP | 2003-35978 | 2/2003 |

* cited by examiner

*Primary Examiner*—Andrew H. Hirshfeld
*Assistant Examiner*—Hoai-An D. Nguyen
(74) *Attorney, Agent, or Firm*—Fitzpatrick, Cella, Harper & Scinto

(57) ABSTRACT

An image forming apparatus includes a plurality of image forming parts, a moving medium continuously moving on the image forming parts, first and second image forming devices, a test image density measuring device, and a control device. The first test image forming device forms a first test image on the medium by using the image forming parts in a first order. The second test image forming device forms a second test image on the medium. The control device controls image forming processing in the image forming parts based on a result of a density measurement of the second test image.

14 Claims, 14 Drawing Sheets

FIG. 12

| FIG. 12A | FIG. 12C |
|---|---|
| FIG. 12B | FIG. 12D |

FIG. 12A

| | Dmax STATION ORDER | Dhalf STATION ORDER | Dmax COLOR ORDER | Dhalf COLOR ORDER | COLOR ORDER VIBRATION 1st | 2nd | 3rd | 4th | PATCH GROUP TOTAL LENGTH (mm) |
|---|---|---|---|---|---|---|---|---|---|
| EMBODIMENT 1 | 2413 | 4231 | MKYC | KMCY | 1 | 1 | -1 | -1 | 500 |
| EMBODIMENT 2 | 3214 | 3421 | CMYK | CKMY | 1 | 1 | 0 | -2 | 510 |
| EMBODIMENT 3 | 3124 | 3421 | CYMK | CKMY | 2 | 0 | 0 | -2 | 510 |
| EMBODIMENT 4 | 3124 | 3412 | CYMK | CKYM | 1 | 1 | 0 | -2 | 520 |
| EMBODIMENT 5 | 3142 | 3412 | CYKM | CKYM | 1 | 0 | 0 | -1 | 520 |
| EMBODIMENT 6 | 1432 | 4312 | YKCM | KCYM | 2 | 0 | -1 | -1 | 520 |
| EMBODIMENT 7 | 4132 | 4312 | KYCM | KCYM | 1 | 0 | -1 | 0 | 520 |
| EMBODIMENT 8 | 1243 | 4213 | YMKC | KMYC | 2 | 0 | 0 | -2 | 530 |
| EMBODIMENT 9 | 2143 | 4213 | MYKC | KMYC | 1 | 1 | 0 | -2 | 530 |
| EMBODIMENT 10 | 1342 | 4312 | YCKM | KCYM | 2 | 0 | 0 | -2 | 530 |
| EMBODIMENT 11 | 3214 | 3241 | CMYK | CMKY | 1 | 0 | 0 | -1 | 530 |
| EMBODIMENT 12 | 1243 | 4231 | YMKC | KMCY | 3 | 0 | -1 | -2 | 530 |
| EMBODIMENT 13 | 2143 | 4231 | MYKC | KMCY | 2 | 1 | -1 | -2 | 530 |
| EMBODIMENT 14 | 4213 | 4231 | KMYC | KMCY | 1 | 0 | -1 | 0 | 530 |
| EMBODIMENT 15 | 1324 | 3124 | YCMK | CYMK | 1 | 0 | -1 | 0 | 540 |
| EMBODIMENT 16 | 1243 | 4123 | YMKC | KYMC | 1 | 1 | 0 | -2 | 540 |
| EMBODIMENT 17 | 1423 | 4123 | YKMC | KYMC | 1 | 0 | 0 | -1 | 540 |
| EMBODIMENT 18 | 1324 | 3142 | YCMK | CYKM | 1 | 1 | -1 | -1 | 540 |
| EMBODIMENT 19 | 1342 | 3142 | YCKM | CYKM | 1 | 0 | -1 | 0 | 540 |
| EMBODIMENT 20 | 1243 | 4132 | YMKC | KYCM | 1 | 2 | -1 | -2 | 540 |
| EMBODIMENT 21 | 1423 | 4132 | YKMC | KYCM | 1 | 1 | -1 | -1 | 540 |
| EMBODIMENT 22 | 1432 | 4132 | YKCM | KYCM | 1 | 0 | 0 | -1 | 540 |
| EMBODIMENT 23 | 1324 | 3412 | YCMK | CKYM | 2 | 1 | -1 | -2 | 540 |
| EMBODIMENT 24 | 1342 | 3412 | YCKM | CKYM | 2 | 0 | -1 | -1 | 540 |
| EMBODIMENT 25 | 2314 | 3241 | MCYK | CMKY | 1 | 1 | -1 | -1 | 540 |

TO FIG. 12B

FIG. 12B

FROM FIG. 12A

| | | | | | | | | | |
|---|---|---|---|---|---|---|---|---|---|
| EMBODIMENT 26 | 1324 | 3421 | YCMK | CKMY | 3 | 0 | -1 | -2 | 540 |
| EMBODIMENT 27 | 2314 | 3421 | MCYK | CKMY | 1 | 2 | -1 | -2 | 540 |
| EMBODIMENT 28 | 2134 | 2314 | MYCK | MCYK | 1 | 0 | -1 | 0 | 550 |
| EMBODIMENT 29 | 2143 | 2413 | MYKC | MKYC | 1 | 0 | 0 | -1 | 550 |
| EMBODIMENT 30 | 2134 | 2341 | MYCK | MCKY | 2 | 0 | -1 | -1 | 550 |
| EMBODIMENT 31 | 2314 | 2341 | MCYK | MCKY | 1 | 0 | 0 | -1 | 550 |
| EMBODIMENT 32 | 2134 | 2431 | MYCK | MKCY | 2 | 0 | 0 | -2 | 550 |
| EMBODIMENT 33 | 2143 | 2431 | MYKC | MKCY | 2 | 0 | -1 | -1 | 550 |
| EMBODIMENT 34 | 2413 | 2431 | MKYC | MKCY | 1 | 0 | -1 | 0 | 550 |
| EMBODIMENT 35 | 2341 | 3241 | MCKY | CMKY | 0 | 1 | -1 | 0 | 550 |
| EMBODIMENT 36 | 2431 | 4231 | MKCY | KMCY | 0 | 1 | 0 | -1 | 550 |
| EMBODIMENT 37 | 2341 | 3421 | MCKY | CKMY | 0 | 2 | -1 | -1 | 550 |
| EMBODIMENT 38 | 3241 | 3421 | CMKY | CKMY | 0 | 1 | -0 | -1 | 550 |
| EMBODIMENT 39 | 2341 | 4321 | MCKY | KCMY | 0 | 2 | 0 | -2 | 550 |
| EMBODIMENT 40 | 2431 | 4321 | MKCY | KCMY | 0 | 2 | -1 | -1 | 550 |
| EMBODIMENT 41 | 4231 | 4321 | KMCY | KCMY | 0 | 1 | -1 | 0 | 550 |
| EMBODIMENT 42 | 2314 | 3214 | MCYK | CMYK | 0 | 1 | -1 | 0 | 570 |
| EMBODIMENT 43 | 2413 | 4213 | MKYC | KMYC | 0 | 1 | 0 | -1 | 570 |
| EMBODIMENT 44 | 2314 | 3412 | MCYK | CKYM | 0 | 3 | -1 | -2 | 570 |
| EMBODIMENT 45 | 3214 | 3412 | CMYK | CKYM | 0 | 2 | 0 | -2 | 570 |
| EMBODIMENT 46 | 1243 | 4312 | YMKC | KCYM | 2 | 2 | -2 | -2 | 570 |
| EMBODIMENT 47 | 1423 | 4312 | YKMC | KCYM | 2 | 1 | -2 | -1 | 570 |
| EMBODIMENT 48 | 2143 | 4312 | MYKC | KCYM | 1 | 3 | -2 | -2 | 570 |
| EMBODIMENT 49 | 4123 | 4312 | KYMC | KCYM | 1 | 1 | -2 | 0 | 570 |
| EMBODIMENT 50 | 2413 | 4312 | MKYC | KCYM | 0 | 3 | -2 | -1 | 570 |
| EMBODIMENT 51 | 4213 | 4312 | KMYC | KCYM | 0 | 2 | -2 | 0 | 570 |
| EMBODIMENT 52 | 2143 | 2341 | MYKC | MCKY | 2 | 0 | -2 | 0 | 570 |
| EMBODIMENT 53 | 1243 | 4321 | YMKC | KCMY | 3 | 1 | -2 | -2 | 570 |
| EMBODIMENT 54 | 1423 | 4321 | YKMC | KCMY | 3 | 0 | -2 | -1 | 570 |
| EMBODIMENT 55 | 2143 | 4321 | MYKC | KCMY | 2 | 2 | -2 | -2 | 570 |

FIG. 12C

| | Dmax STATION ORDER | Dhalf STATION ORDER | Dmax COLOR ORDER | Dhalf COLOR ORDER | COLOR ORDER VARIATION 1st | 2nd | 3rd | 4th | PATCH GROUP TOTAL LENGTH (mm) |
|---|---|---|---|---|---|---|---|---|---|
| EMBODIMENT 56 | 4123 | 4321 | KYMC | KCMY | 2 | 0 | -2 | 0 | 570 |
| EMBODIMENT 57 | 2413 | 4321 | MKYC | KCMY | 1 | 2 | -2 | -1 | 570 |
| EMBODIMENT 58 | 4213 | 4321 | KMYC | KCMY | 1 | 1 | -2 | 0 | 570 |
| EMBODIMENT 59 | 1234 | 4132 | YMCK | KYCM | 1 | 2 | 0 | -3 | 580 |
| EMBODIMENT 60 | 1234 | 4312 | YMCK | KCYM | 2 | 2 | -1 | -3 | 580 |
| EMBODIMENT 61 | 1324 | 4312 | YCMK | KCYM | 2 | 1 | 0 | -3 | 580 |
| EMBODIMENT 62 | 2134 | 4312 | MYCK | KCYM | 1 | 3 | -1 | -3 | 580 |
| EMBODIMENT 63 | 2314 | 4312 | MCYK | KCYM | 0 | 3 | 0 | -3 | 580 |
| EMBODIMENT 64 | 1234 | 4231 | YMCK | KMCY | 3 | 0 | 0 | -3 | 580 |
| EMBODIMENT 65 | 2134 | 4231 | MYCK | KMCY | 2 | 1 | 0 | -3 | 580 |
| EMBODIMENT 66 | 1234 | 4321 | YMCK | KCMY | 3 | 1 | -1 | -3 | 580 |
| EMBODIMENT 67 | 1324 | 4321 | YCMK | KCMY | 3 | 0 | 0 | -3 | 580 |
| EMBODIMENT 68 | 2134 | 4321 | MYCK | KCMY | 2 | 2 | -1 | -3 | 580 |
| EMBODIMENT 69 | 2314 | 4321 | MCYK | KCMY | 1 | 2 | 0 | -3 | 580 |
| EMBODIMENT 70 | 1234 | 3124 | YMCK | CYMK | 1 | 1 | -2 | 0 | 590 |
| EMBODIMENT 71 | 2134 | 3124 | MYCK | CYMK | 0 | 2 | -2 | 0 | 590 |
| EMBODIMENT 72 | 2143 | 4123 | MYKC | KYMC | 0 | 2 | 0 | -2 | 590 |
| EMBODIMENT 73 | 1234 | 3142 | YMCK | CYKM | 1 | 2 | -2 | -1 | 590 |
| EMBODIMENT 74 | 2134 | 3142 | MYCK | CYKM | 0 | 3 | -2 | -1 | 590 |
| EMBODIMENT 75 | 3124 | 3142 | CYMK | CYKM | 0 | 1 | 0 | -1 | 590 |
| EMBODIMENT 76 | 2134 | 4132 | MYCK | KYCM | 0 | 3 | 0 | -3 | 590 |
| EMBODIMENT 77 | 2143 | 4132 | MYKC | KYCM | 0 | 3 | -1 | -2 | 590 |
| EMBODIMENT 78 | 4123 | 4132 | KYMC | KYCM | 0 | 1 | -1 | 0 | 590 |
| EMBODIMENT 79 | 1234 | 3214 | YMCK | CMYK | 2 | 0 | -2 | 0 | 590 |
| EMBODIMENT 80 | 2134 | 3214 | MYCK | CMYK | 1 | 1 | -2 | 0 | 590 |

TO FIG. 12D

FIG. 12D

FROM FIG. 12C

| | | | | | | | | | |
|---|---|---|---|---|---|---|---|---|---|
| EMBODIMENT 81 | 1234 | 3412 | YMCK | CKYM | 2 | 2 | -2 | -2 | 590 |
| EMBODIMENT 82 | 1432 | 3412 | YKCM | CKYM | 2 | 0 | -2 | 0 | 590 |
| EMBODIMENT 83 | 2134 | 3412 | MYCK | CKYM | 1 | 3 | -2 | -2 | 590 |
| EMBODIMENT 84 | 1234 | 3241 | YMCK | CMKY | 3 | 0 | -2 | -1 | 590 |
| EMBODIMENT 85 | 2134 | 3241 | MYCK | CMKY | 2 | 1 | -2 | -1 | 590 |
| EMBODIMENT 86 | 1234 | 3421 | YMCK | CKMY | 3 | 1 | -2 | -2 | 590 |
| EMBODIMENT 87 | 2134 | 3421 | MYCK | CKMY | 2 | 2 | -2 | -2 | 590 |
| EMBODIMENT 88 | 2431 | 3421 | MKCY | CKMY | 0 | 2 | -2 | 0 | 590 |
| COMPARATIVE EXAMPLE 1 | 1234 | 1234 | YMCK | YMCK | 0 | 0 | 0 | 0 | 610 |
| COMPARATIVE EXAMPLE 3 | 1234 | 1324 | YMCK | YCMK | 0 | 1 | -1 | 0 | 610 |
| COMPARATIVE EXAMPLE 4 | 1243 | 1423 | YMKC | YKMC | 0 | 1 | 0 | -1 | 610 |
| COMPARATIVE EXAMPLE 5 | 1234 | 1342 | YMCK | YCKM | 0 | 2 | -1 | -1 | 610 |
| COMPARATIVE EXAMPLE 6 | 1243 | 1342 | YMKC | YCKM | 0 | 2 | -2 | 0 | 610 |
| COMPARATIVE EXAMPLE 7 | 1324 | 1342 | YCMK | YCKM | 0 | 1 | 0 | -1 | 610 |
| COMPARATIVE EXAMPLE 8 | 1234 | 1432 | YMCK | YKCM | 0 | 2 | 0 | -2 | 610 |
| COMPARATIVE EXAMPLE 9 | 1243 | 1432 | YMKC | YKCM | 0 | 2 | -1 | -1 | 610 |
| COMPARATIVE EXAMPLE 10 | 1423 | 1432 | YKMC | YKCM | 0 | 1 | -1 | 0 | 610 |
| COMPARATIVE EXAMPLE 11 | 1243 | 3142 | YMKC | CYKM | 1 | 2 | -3 | 0 | 640 |
| COMPARATIVE EXAMPLE 12 | 2143 | 3142 | MYKC | CYKM | 0 | 3 | -3 | 0 | 640 |
| COMPARATIVE EXAMPLE 13 | 1243 | 3412 | YMKC | CKYM | 2 | 2 | -3 | -1 | 640 |
| COMPARATIVE EXAMPLE 14 | 1423 | 3412 | YKMC | CKYM | 2 | 1 | -3 | 0 | 640 |
| COMPARATIVE EXAMPLE 15 | 2143 | 3412 | MYKC | CKYM | 1 | 3 | -3 | -1 | 640 |
| COMPARATIVE EXAMPLE 16 | 2413 | 3412 | MKYC | CKYM | 0 | 3 | -3 | 0 | 640 |
| COMPARATIVE EXAMPLE 17 | 1243 | 3241 | YMKC | CMKY | 3 | 0 | -3 | 0 | 640 |
| COMPARATIVE EXAMPLE 18 | 2143 | 3241 | MYKC | CMKY | 2 | 1 | -3 | 0 | 640 |
| COMPARATIVE EXAMPLE 19 | 1243 | 3421 | YMKC | CKMY | 3 | 1 | -3 | -1 | 640 |
| COMPARATIVE EXAMPLE 20 | 1423 | 3421 | YKMC | CKMY | 3 | 0 | -3 | 0 | 640 |
| COMPARATIVE EXAMPLE 21 | 2143 | 3421 | MYKC | CKMY | 2 | 2 | -3 | -1 | 640 |
| COMPARATIVE EXAMPLE 22 | 2413 | 3421 | MKYC | CKMY | 1 | 2 | -3 | 0 | 640 |

IMAGE FORMING APPARATUS AND IMAGE FORMATION CONTROL METHOD IN THE SAME

BACKGROUND OF THE INVENTION

1. Field of the Invention

The present invention relates to an image forming apparatus such as, for example, a printer or a copying machine, and more particularly to an image forming apparatus having an arrangement of a plurality of image forming parts and an image formation control method in the same.

2. Related Background Art

In recent years, a printer as an image output terminal has rapidly become popular. Particularly, with an advance of colorization, there are increasing demands for improving stability of printed image qualities in a color printer and for equalization of color image qualities among color printers. Particularly, color reproducibility on a printed image is required to have advanced stability of image reproduction independent of a change in the installation environment, a change with time, and a difference in printer type. In an electrophotographic image forming apparatus such as a laser beam printer, however, image reproducibility fluctuates due to a change in environmental condition where the apparatus is placed or deterioration with time of a photosensitive member or developer. Therefore, it cannot satisfy the high desired values over the long term if there is no change in the initialization. Accordingly, in this type of color printer, it is common to conduct a feedback control for maintaining the image density optimally.

The feedback control is performed as described below. First, a density patch is formed on a cyclically moving member such as, for example, a photosensitive member, an intermediate transferring member, or a transferring and transporting belt and then a density of the formed density patch is measured. A control factor of the patch density is then controlled in such a way that the density of the density patch is close to a target density, considering a surrounding environment, deterioration with time, and a nonuniformity in solid. There is also suggested a method of forming a density patch on a recording medium such as recording paper and measuring the patch density on the recording medium to perform the same control.

For example, Japanese Patent Application Laid-Open No. H1-169567 discloses a method of measuring a density of a density patch and controlling an exposure condition or a developing bias condition of a laser beam to achieve a desired image density. As a density patch in this case, there is a density patch of an unfixed developed image after a developing process or an image density patch after a fixing process. The reason for using the image density patch here is that it enables an evaluation of the image quality including density fluctuations in the transferring process or the fixing process due to monitoring the image in the same condition as one a user obtains finally. As the feedback control using the density patch, there have already been known a density control for determining a control factor affecting image characteristics such as the highest density, a line width, fogging, or the like (hereinafter, referred to as Dmax control) and a halftone control for correcting linearity (gamma characteristic) of a halftone reproduction (hereinafter, referred to as Dhalf control), as disclosed in, for example, Japanese Patent Application Laid-Open Nos. H7-209934, H10-39555, H11-119481. The Dhalf control for controlling the halftone reproducibility is generally performed after the Dmax control in order to use a result of the Dmax control.

Thus, a gamma correction after controlling the highest density to a predetermined value keeps the linearity and regularity of the density.

A normal printing operation cannot be performed during the above calibration, thus the user have to wait for the finishing the calibration to execute the printing operation. Therefore, it is required to reduce the time for the calibration as greatly as possible. In addition, in calibration for printing a test pattern on paper or other recording medium, it is required to minimize a quantity consumed of recording medium (recording paper), which is a user resource.

SUMMARY OF THE INVENTION

The present invention has been provided in view of the above problems.

The object of the present invention is to decrease a load imposed on a user by reducing the time for calibration for obtaining image forming conditions in image forming parts.

Another object of the present invention is to provide an image forming apparatus, comprising: a plurality of image forming parts; a moving medium continuously moving on the plurality of image forming parts according to an arrangement order of the plurality of image forming parts; the first test image forming means for forming the first test image on the moving medium by using the plurality of image forming parts in the first order; a density measuring means for measuring a density of the test image formed on the moving medium by using the first test image forming means; the second test image forming means for forming the second test image on the moving medium by setting the first image forming condition in a corresponding image forming part based on a result of measuring the density of the first test image using the density measuring means and by using the corresponding image forming part based on the first image forming condition in the second order; and a control means for controlling image forming processing in the plurality of image forming parts according to the first and second image forming conditions by setting the second image forming condition in each of the plurality of image forming parts based on a result of measuring the density of the second test image by using the density measuring means, wherein the first test image and the second test image are formed within predetermined dimensions by applying specific orders to the first and second orders, respectively.

A still further object of the present invention is to provide an image forming control method in an image forming apparatus, comprising the steps described below. Specifically, it is an image forming control method in an image forming apparatus having a plurality of image forming parts and forming an image on a moving medium continuously moving on the plurality of image forming parts according to an arrangement order of the plurality of image forming parts, comprising the steps of: forming the first test image on the moving medium by using the plurality of image forming parts in the first order; measuring a density of the test image formed on the moving medium in the first test image forming step; setting the first image forming condition in a corresponding image forming part based on a result of measuring the density of the first test image in the density measuring step; forming the second test image on the moving medium by using the corresponding image forming part based on the first image forming condition in the second order; setting the second image forming condition in each of the plurality of image forming parts based on a result of measuring the density of the second test image; and controlling image forming processing in the plurality of image forming parts according to the first and second image forming conditions, wherein the first test image and the second test image are formed within specific dimensions by applying different orders to the first and second orders. According to the present invention, there is an effect of forming an image under optimum image forming conditions with a reduction of time for calibration.

Other objects, features, and effects of the present invention will become apparent from the following detailed description taken in conjunction with the accompanying drawings.

BRIEF DESCRIPTION OF THE DRAWINGS

FIGS. 12A, 12B, 12C and 12D shows a table for explaining color orders according to the second embodiment of the present invention.

DETAILED DESCRIPTION OF THE PREFERRED EMBODIMENTS

The preferred embodiments of the present invention will now be described in detail hereinafter with reference to the accompanying drawings.

Figure 1:
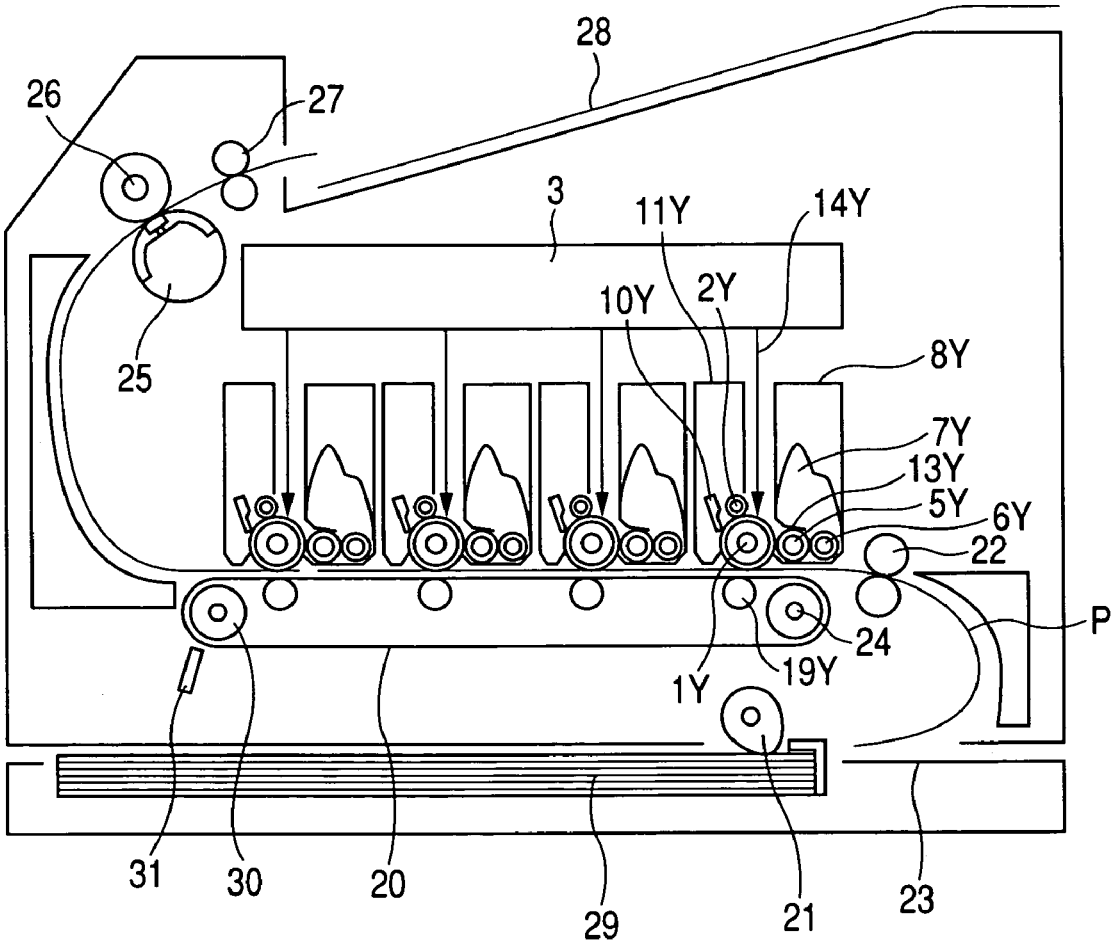
FIG. 1 is a cross section for explaining an image forming apparatus according to an embodiment of the present invention.

Referring to FIG. 1, there is shown a schematic cross sectional view of a color image forming apparatus (a color laser beam printer) according to an embodiment of the present invention.

In the color image forming apparatus, an electrophotographic system is applied to image forming parts. A latent image is formed by means of optical writing of irradiating a photosensitive drum provided for each color with a laser beam, converting (developing) the latent image to a toner image. The developed toner image is transferred to paper and fixed on it. Generally, for reproducing a color image on paper, a full color image is represented by sequentially superimposing four colors in total, including the three subtractive primary colors, yellow (Y), magenta (M: Red color), and cyan (C: Greenish blue) toners, and a black (K) toner for use in printing characters or a black part of an image or an image formation.

As shown in FIG. 1, a paper cassette 23 is detachably attached in the lower part of the apparatus body. After a control part 100 (FIG. 3) receives a print instruction from a host computer, paper 29 in the paper cassette 23 is taken out in units of a sheet by rotationally driving a feeding roller 21 at predetermined timings. The paper (recording material) P taken out in this way is conveyed to a registration roller pair 22 and stops at the position where the front end of the paper comes up against the registration roller pair 22 and is caught between the registration rollers.

After an image formation is started in preparation therefor, the paper P is fed into the image forming parts at predetermined timings by a rotation of the registration roller pair 22. The registration roller pair 22 has functions of adjusting feeding timings of the paper P and positioning the front end of the paper so as to be substantially perpendicular to a conveying direction. Although reference characters have been used only for image forming parts of yellow (Y) for the first image forming station in FIG. 1, magenta (the second station), cyan (the third station), and black (the fourth station) image forming stations each having the same arrangement as yellow are disposed in this order as shown on the downstream side in the conveying direction of the paper P.

In this regard, while a method of forming a toner image of each color is not limited particularly, a toner image is developed by a known developing method such as, for example, two-component development or nonmagnetic one-component development. The following describes an example of an image forming apparatus using a nonmagnetic one-component contact developing method.

Upon receiving a laser beam 14Y from an exposure unit 3 after a surface of a photosensitive drum 1Y is charged by a charging roller 2Y powered by a high-voltage power supply not shown, an electrostatic latent image is formed on the surface of the photosensitive drum 1Y. A developing roller 5Y abuts on the electrostatic latent image, toner is transferred to a portion corresponding to the electrostatic latent image of the paper, and thereby a toner image is obtained. The developing roller 5Y abuts on a supplying/scraping roller 6Y for supplying the surface of the developing roller 5Y with toner or for scraping the toner from the surface of the developing roller 5Y, with a peripheral velocity difference. The supplying/scraping roller 6Y also plays a role of charging the toner on the developing roller 5Y. A toner layer thickness regulating blade 13Y regulates a layer thickness of the toner on the developing roller 5Y and supplies the photosensitive drum 1Y with the toner frictionally charged by abrading so as to be suitable for development. A transferring roller 19Y transfers the toner image formed on the photosensitive drum 1Y in this manner to the paper P. In this regard, an electrostatic absorption transporting belt 20 (hereinafter, referred to as ETB) is disposed between the photosensitive drum 1Y and the transferring roller 19Y. The ETB 20 is moved due to a rotation of a driving roller 30 and conveys the paper P to the color stations Y, M, C, and K in this order while absorbing the paper P. A tension roller 24 is put under pressure in a direction of stretching the ETB 20 so as to prevent the ETB 20 from coming loose and is driven to rotate with the motion of the ETB 20. The conveyance of the paper P with the ETB 20 enhances an accuracy of position in the transfer to the paper P to decrease misalignment of the image in colors. In this transfer, a cleaning part 10Y abuts on the photosensitive drum 1Y for cleaning by collecting transfer residual toner remaining on the photosensitive drum 1Y without being used for the transfer. The toner collected by the cleaning part 10Y is placed in a waste toner container 11Y.

The paper P to which the yellow image has been transferred is separated from the photosensitive drum 1Y. Subsequently, it is conveyed to the next image forming station, and magenta, cyan, and black toner images formed in the same image forming method as for yellow are sequentially transferred to the yellow toner image. The paper P to which the color images have been transferred is conveyed to a fixing nip portion formed by a pressure roller 26 and a heating apparatus 25 opposed thereto. The toner image on the paper P is put under heat and pressure in the fixing nip portion, by which the toner melts, sticks fast to the paper P, and generates a permanent image. The paper P on which the color image has been printed is conveyed to the outside of the image forming apparatus by a discharging roller 27 and then put on a discharge tray so that the user can get a final printed image 28.

Incidentally, as a problem of the electrophotographic image forming apparatus, a density of the image formed on the paper P fluctuates according to temperature and relative humidity conditions in which the image forming apparatus is used or a frequency in use of the image forming stations of the respective colors. The image density is controlled to correct the fluctuations of the image density.

First, to detect a density of the image to be formed, density patch images of the colors are formed on the ETB 20 and a density sensor 31 reads them. While the density detecting method is not limited particularly here, for example, an optical density sensor can be used preferably.

Figure 2:
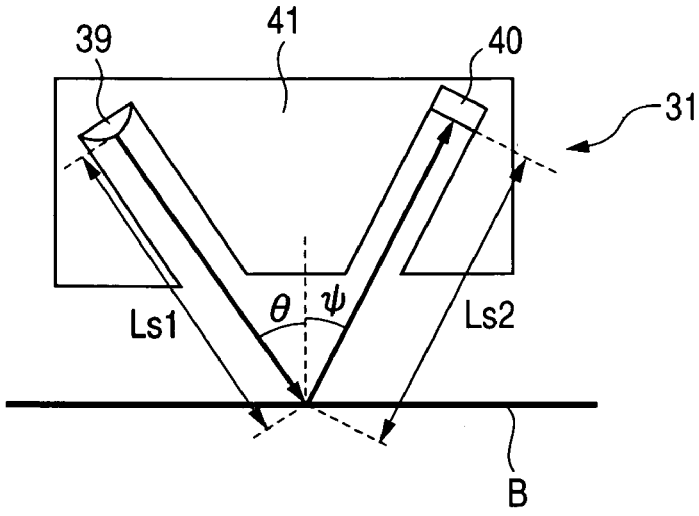
FIG. 2 is a diagram for explaining a density sensor for use in the image forming apparatus according to the embodiment.

Referring to FIG. 2, there is shown a diagram for explaining an example of the density sensor 31 according to this embodiment.

A light emitting element 39 such as an LED and a light receiving element 40 such as a photo diode are attached to a housing 41. The housing 41 is generally provided with a tunnel-type optical path for regulating and guiding an emitted light beam and a tunnel-type optical path for regulating and guiding a light beam incident on the light receiving element 40. In this embodiment, an adjustment is made to achieve desired characteristics of an irradiated area in the light emitting side and a sensible area in the light receiving side on a surface of a measured object B according to distances Ls1 and Ls2 from the light emitting element and the light receiving element to the measured object B. The housing 41 has a role of covering the light receiving element 40 so that the light from the light emitting element 39 does not directly impinge on the light receiving element 40, and therefore it is made of a material having an extremely low optical transmittance relative to a wavelength of the central light emission of the light emitting element 39. The incident light of the light emitting element 39 impinges on the measured object B at an angle θ and reflected by the measured object B. The light receiving element 40 is opposed to the measured object B at an angle ψ and detects both of a regular reflection light and a diffused reflection light from the measured object B. In general, θ is equal to ψ, which is 30° in this embodiment.

The following describes a principle of sensing a density patch using the density sensor 31.

A light beam emitted from the light emitting element 39 is reflected on the surface at a reflectance, which is determined by a refractive index peculiar to a quality of the material of the ETB 20 to be a base and its surface condition, and the light receiving element 40 detects the reflected light. When a density patch is formed on the surface, an amount of reflected light decreases in a toner portion since the base of the ETB 20 is covered. Therefore, the amount of reflected light decreases with an increase in an amount of toner of the density patch. Accordingly, the density of the density patch is calculated based on the amount of decrease in the reflected light. Practically, the surface condition of the base of the ETB 20 varies according to the frequency in use of the ETB 20, which is the measured surface, by which the amount of reflected light varies, too.

Therefore, generally the amount of reflected light of the density patch is standardized by the amount of reflected light of the base of the ETB 20 and then converted to density information.

In measuring a patch of color toner having a significant diffused reflection, an increase in a reflected light of the diffused reflection becomes larger than the decrease in a reflected light on the ETB 20 with the increase in the amount of toner and thereby the increase in the amount of toner sometimes does not cause monotone decreasing of the output from the sensor 31. For this situation, there have been suggested a density sensor with an additional light receiving element for measuring the diffused reflection light and a density sensor having a built-in deflecting plate and measuring a P wave and an S wave. These sensors can be preferably used for this embodiment. This type of sensor is particularly effective for measuring on a curved surface or for a low reflectance of the ETB 20. In addition, preferably the foregoing density sensor 31 has a time resolution in the order of 100 ms to 100 μs and a spatial resolution in the order of 0.1 mm to 10 mm.

A light amount signal from the density sensor 31 is A/D-converted and then processed in a CPU 110 (FIG. 3), by which a value corresponding to a density is calculated. It is an image control described below to optimize the highest densities (maximum density: Dmax) of the respective colors and halftone gradation characteristics (Dhalf) by a feedback to high-voltage condition or a process forming condition such as laser power based on the result of the calculation. There are two types of image controls: a control for keeping the highest density constant (Dmax control) and a control for keeping the halftone gradation characteristics linear to an image signal (Dhalf control). In addition to keeping the color balance of the respective colors constant, the Dmax control has also a significant role of preventing spots around multiple-colored characters caused by excessive toner or of preventing a fixing failure. Specifically, the Dmax control is to detect a plurality of density patches formed under different image forming conditions significantly affecting the image densities such as a charging DC bias or a developing DC bias by using an optical sensor, to calculate an image forming condition by which the desired highest density is obtained based on the result (hereinafter, referred to as Dmax calculation), and to change the image forming condition. In this embodiment, the developing bias is varied during the patch formation and a result of the Dmax calculation is reflected on the change of the developing bias.

In this regard, the density patch is preferably formed in halftone in the order of 50% of a printing rate in many cases. The reason is that, if a solid image is detected, a variation range of the sensor output is narrow relative to the change in the amount of toner and thereby a sufficiently high degree of accuracy in detection is not achieved.

On the other hand, the Dhalf control is to perform image processing that maintains a linear input-output characteristic by negating a y characteristic, in order to prevent an occurrence of an unsuccessful formation of a natural image, which may be caused by an output density deviation from an input image signal due to a nonlinear input-output characteristic (the y characteristic) peculiar to the electrophotography. Specifically, the plurality of density patches formed based on different image signals are detected using an optical sensor to obtain a relation between the image signal and the density. The control part 100 (FIG. 3) converts the input image signal from the host computer so as to obtain a desired density based on the relation. Generally, the Dhalf control is performed after determining the image forming condition by the Dmax control.

Figure 3:
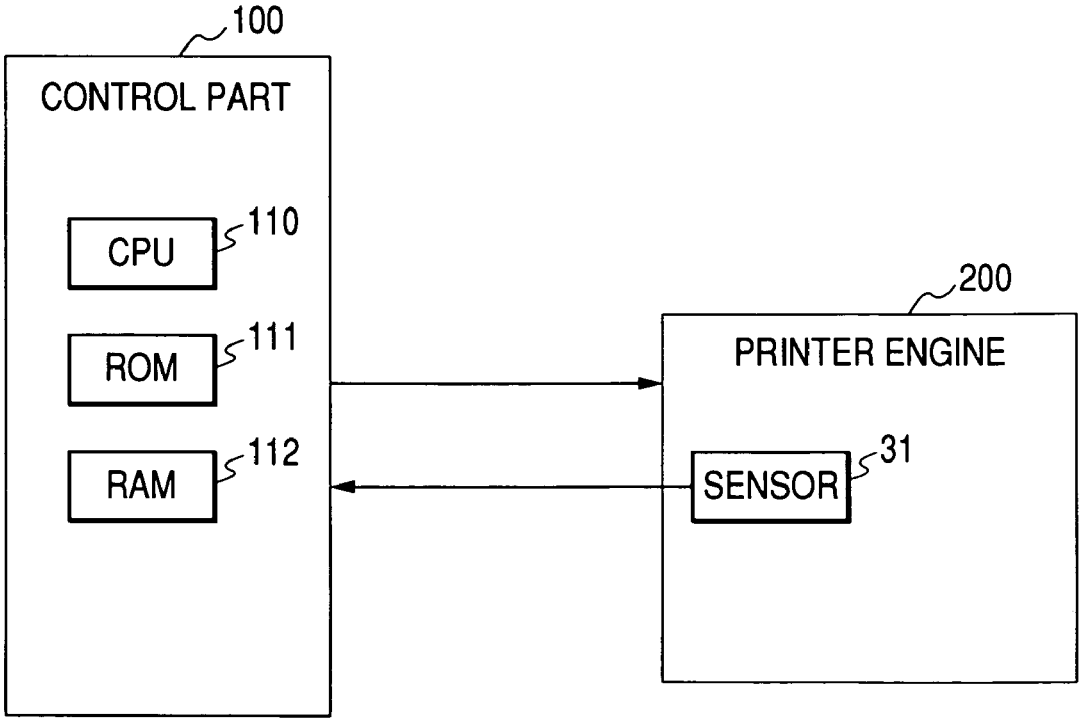
FIG. 3 is a block diagram showing an outline arrangement of the image forming apparatus according to the embodiment.

Referring to FIG. 3, there is shown a block diagram illustrating an outline arrangement of an image forming apparatus according to this embodiment.

In FIG. 3, the control part 100 executes operations of the entire image forming apparatus and various controls described later. A printer engine 200 forms an image in an electrophotographic process, having the configuration as shown in FIG. 1 stated above. The control part 100 comprises a CPU 110 such as a microcomputer, a ROM 111 storing programs executed by the CPU 110 and data, and a RAM 112 for use in control processing with the CPU 110 and temporarily saving various data.

Figure 4:
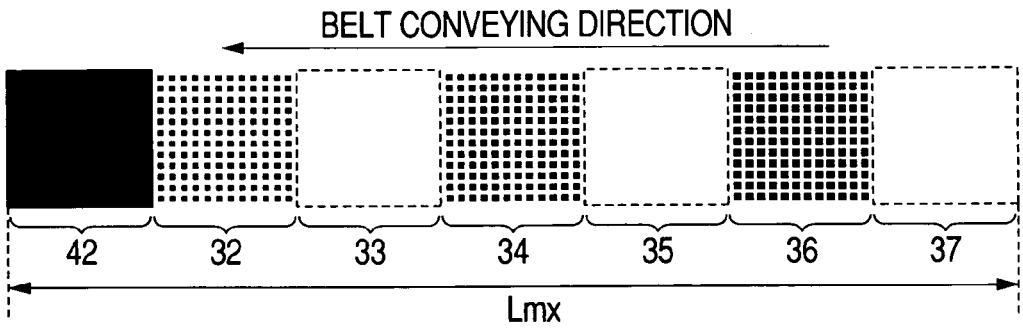
FIG. 4 is a pattern diagram for explaining a Dmax patch group in the image forming apparatus according to the embodiment.

Referring to FIG. 4, there is shown a diagram of a patch group for use in the Dmax control described above.

In this diagram, toner images formed on the ETB 20 are typically shown for one color, where the ETB 20 is moving in the direction indicated by an arrow in FIG. 4. A solid patch 42 having a printing rate of 100% is provided for calibration of the density sensor 31 or for detecting the beginning of a patch group. A toner patch 32 is made of a lot of dots and it is, for example, an image made by repeating a pattern of 4×4 solid dots in a square form. Although patches 34 and 36 are formed based on the same image data (density value) as for the patch 32, the developing bias is varied in forming them so that an amount of toner development gradually increases. The developing bias changes during development of blank areas 33 and 35.

A blank area 37 may be provided, if necessary, for preparation time for an image formation in each image forming station in the downstream such as, for example, for switching of a transferring bias. Reference Lmx indicates a total length of the Dmax patch group per color, which is 50 mm in this embodiment. The patch group is formed for each image forming station and arranged in a straight line on the ETB 20.

The density sensor 31 measures image densities of the plurality of Dmax patches different in developing bias and the CPU 110 performs a linear interpolation of the measured values and calculates a developing bias to be a target density for each image forming station. The developing bias for each station is set to the calculated optimum developing bias, and then subsequent Dhalf patches are formed.

Figure 5:
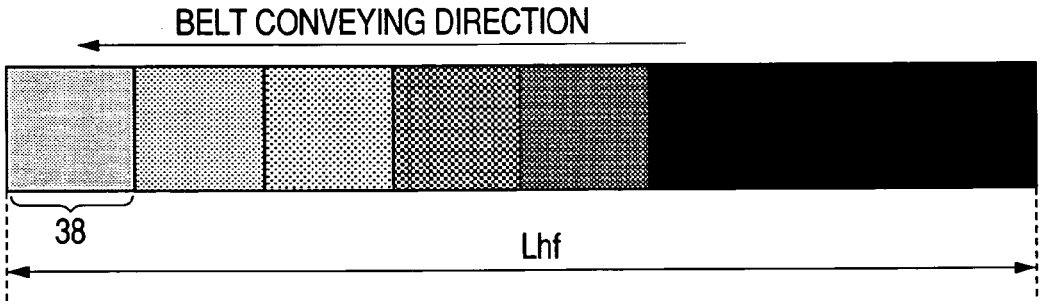
FIG. 5 is a pattern diagram for explaining a Dhalf patch group in the image forming apparatus according to the embodiment.

Referring to FIG. 5, there is shown a diagram illustrating an example of a Dhalf patch group for use in the Dhalf control in this embodiment.

In FIG. 5, the length of each patch 38 in the moving direction of the ETB 20 is approx. 8.5 mm. In this embodiment, eight patches different in density of image data are formed along the moving direction of the ETB 20, having the total length Lhf of 70 mm. In the formation of the Dhalf patch group, the toner development condition is fixed to the condition obtained by the foregoing Dmax control, only with variation of image data. In this embodiment, the patches are formed in such a way that the toner density gradually increases in units of a patch in the opposite direction to the moving direction of the ETB 20. The patch group is formed for each image forming station in the same manner as for the Dmax patch group and arranged in a straight line on the ETB 20. The density sensor 31 measures the toner densities of the patches to calculate the γ characteristic, which is a relational expression of the image data to the density data (measured values), and the control part 100 determines a method of correcting the image data so as to achieve a desired γ characteristic.

In the Dmax and Dhalf patch groups shown in FIGS. 4 and 5, if the length of a patch is too short, namely, 1 mm or less, an edge effect has a significant impact on the patch, thereby causing differences in densities from the original ones. On the other hand, if it is too long, namely, 50 mm or more, much exceeding the detection time or the spatial resolution of the density sensor 31, the developer (toner) is wasted undesirably. At least two patches are required to perform the calculations, but a drastic improvement in the accuracy of measurement cannot be expected with too many patches. Therefore, the number of patches is preferably 100 or less, and more preferably 3 to 10 or so. Furthermore, if the total lengths Lmx and Lhf of the patch groups are to 6 long, the toner consumption increases undesirably. If they are in the order of several millimeters to 300 mm, the patches can be used preferably.

Both of the foregoing Dmax control and the Dhalf control are performed to determine the image forming conditions peculiar to the individual image forming stations. Therefore, it is preferable to form the patches in a single color, instead of superposing different toner colors, and preferable to form the patch groups in such places that they do not overlap with each other on the ETB 20. The density patches formed on the ETB 20 move around on the ETB 20 and collected in a cleaner disposed in the image forming stations by means of a cleaning process. During the cleaning process, a bias having the same polarity as the charging polarity of the toner is applied to the transferring roller to attract the rounding patches to the photosensitive drum in the transferring part, and the toner is scraped off by the cleaning blade and collected in the waste toner container in the same manner as for the transfer residual toner. This arrangement eliminates a need for providing a cleaner abutting on the ETB 20 separately, thereby achieving downsizing of the apparatus and facilitating the maintenance. Note that, however, a transferring bias having a reverse polarity to the polarity in the normal transfer is applied in the image forming station collecting the rounding patches and a transfer cannot be carried out even if new patches are formed. Therefore, the cleaning and the transfer are performed exclusively in the image forming station.

Incidentally, for an accurate density detection in both the Dmax control and the Dhalf control, it is preferable to prevent unnecessary toner and paper lint or other dust from adhering to the ETB 20 as a base. Therefore, desirably the ETB 20 is cleaned before conducting the Dmax control or the Dhalf control. Furthermore, to reduce noise factors such as a scratch on the ETB 20 as greatly as possible, it is more preferable to measure a surface density of the ETB 20 just before the patch formation previously using the density sensor 31 and to correct a result of the practical patch measurement based on the measured value. For example, as described in Japanese Patent Application Laid-Open No. 2003-35978, conventionally the Dmax control and the Dhalf control have been able to be started independently of each other and, in each control, four steps of a patch group formation, a patch group measurement, a patch group calculation, and a feedback to the control have been sequentially performed, while in a particular case the Dmax control and the Dhalf control have been started sequentially.

Like the image forming apparatus according to this embodiment, however, if the apparatus has such a cyclically moving belt (ETB) 20 where the formed patches can move around on the patch bearing member, but a transfer of new patches and cleaning of the rounding patches cannot be performed concurrently, the patches formed on the ETB 20 need be removed before the subsequent control starts. Therefore, if the Dmax control and the Dhalf control, which can be executed independently of each other, are executed sequentially, the total calibration time becomes sometimes extremely long.

For example, the ETB 20 is moved around once before the Dmax patch formation for cleaning, the ETB 20 is moved around one more time for a base measurement of the ETB 20, and in the next round the Dmax patch group formation and the density measurement are performed. After reading all the Dmax patches, the Dmax calculation is made. In the next round, cleaning for the Dmax patch group is performed and then the ETB 20 is moved around four times to terminate the Dmax control. Subsequently, with setting of the image forming condition calculated in the Dmax control, the Dhalf control is started. In this control, in the same manner as for the Dmax control, the ETB 20 is moved around once for cleaning, it is moved around one more time for a base measurement, and in the next round the Dhalf patch group formation and the density measurement are performed. In the subsequent round, cleaning for the Dhalf patch group and both controls are executed sequentially. In this procedure, the ETB 20 need be moved around eight times in total. Even if the first cleaning of the Dhalf control is omitted and the base measurement of the Dmax control is used as a substitute for the base measurement of the Dhalf control, the calibration requires the rotation time for moving the ETB 20 around six times in total.

Therefore, as in the embodiment, in the image forming apparatus in which patches are formed on the ETB 20 and the patches can be moved around, the foregoing Dmax patch group and the Dhalf patch group are formed within a single round of the ETB 20, thereby reducing the time for the calibration. Specifically, the ETB 20 is cleaned in the first round, and the base of the ETB 20 is measured in the next round. In the subsequent round, the Dmax calculation is made in parallel with the Dmax patch formation and the Dhalf patches are formed one by one. Then, in the final round, the ETB 20 is cleaned. This enables the calibration to be completed by moving the ETB 20 around only four times. In forming the Dmax patch group and the Dhalf patch group in succession, the density measurement of the Dmax patch groups of all colors should not be followed by each Dmax control calculation. Preferably, when a Dmax patch group of a certain image forming station passes a density sensor position and the measurement is terminated, the Dmax calculation of the image forming station is made even before the end of measurement of all image forming stations, and the Dhalf patch group formation of the same image forming station is started so that it does not overlap with the patch groups formed by other image forming stations.

The following describes a necessary distance between the Dmax patch group and the Dhalf patch group.

Figure 6:
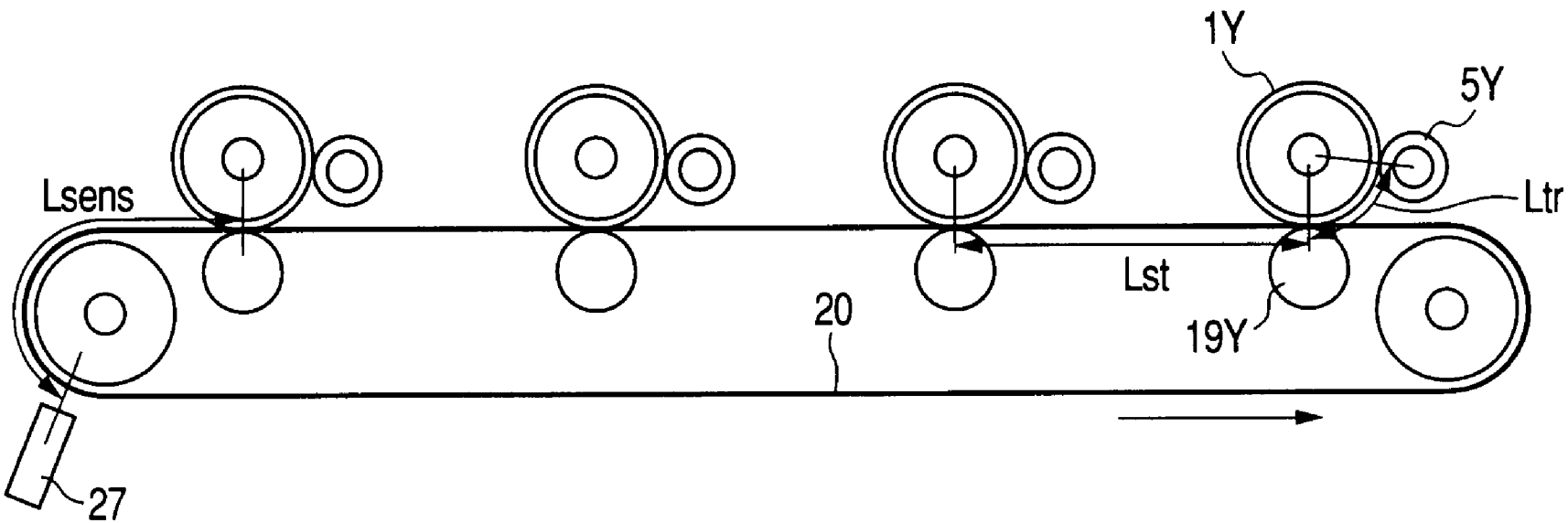
FIG. 6 is a schematic view for explaining timings related to a patch formation and a density measurement in the image forming apparatus according to the embodiment.

Referring to FIG. 6, there is shown a schematic view for explaining timings related to a patch formation and a density measurement in the image forming apparatus according to the embodiment. The same reference characters have been retained for the same parts as in the foregoing drawings, and their description is omitted here.

As stated above, a patch is formed on the ETB 20 in each image forming station and moved to a position opposite to the density sensor 31 by a circular movement of the ETB 20 in the direction indicated by an arrow, and the density sensor 31 measures the patch densities. Reference Ltr indicates a distance between a developing part (an opposite part of the photosensitive drum 1Y to the developing roller 5Y) and a transferring part (an opposite part of the photosensitive drum 1Y to the transferring roller 19Y) on a circumferential surface of the photosensitive drum, and it is 35 mm in this embodiment. Reference Lst indicates a distance between a Y station transferring part and an M station transferring part on a circumferential surface of the ETB 20. All distances between Y and M, M and C, and C and K are equally 60 mm. Reference Lsens indicates a distance between a transferring part of the final station (K) and a detecting part of the density sensor 31 on the circumferential surface of the ETB 20 and it is 65 mm in this embodiment. The peripheral length of the ETB 20 is 600 mm.

A patch formed in the first station (station Y) located on the most upstream side among the image forming stations arranged as shown is most distant away from the position opposed to the density sensor 31, thereby having the longest time lag between the patch formation and the patch measurement. Thus, the time between the Dmax patch group formation and the end of the Dmax patch group measurement in which the station is ready for starting the Dhalf patch group formation depends upon each image forming station.

Specifically, the minimum idle running distance from the rear end of the Dmax patch group to the front end of the Dhalf patch group (corresponding to the above time lag) is as follows:

First station (Y): Ltr+Lsens+3Lst=280 mm
Second station (M): Ltr+Lsens+2Lst=220 mm
Third station (C): Ltr+Lsens+2Lst=160 mm
Fourth station (K): Ltr+Lsens=100 mm In this embodiment, the total length Lmx of the Dmax patch group per color is 50 mm and the total length Lhf of the Dhalf patch group is 70 mm and both are shorter than the idle running distances. Therefore, color orders of the Dmax patch group and the Dhalf patch group are modified and during their time lags the Dmax patches and the Dhalf patches of other stations are formed as described below. This enables the patch groups to be closely arranged on the ETB 20 and therefore the Dmax control and the Dhalf control can be completed within a single round of the ETB 20 having a shorter circumference.

Hereinafter, the preferred embodiments of the present invention will be described by giving concrete examples. Unless otherwise specified, the foregoing image forming apparatus is used.

First Embodiment

Figure 7:
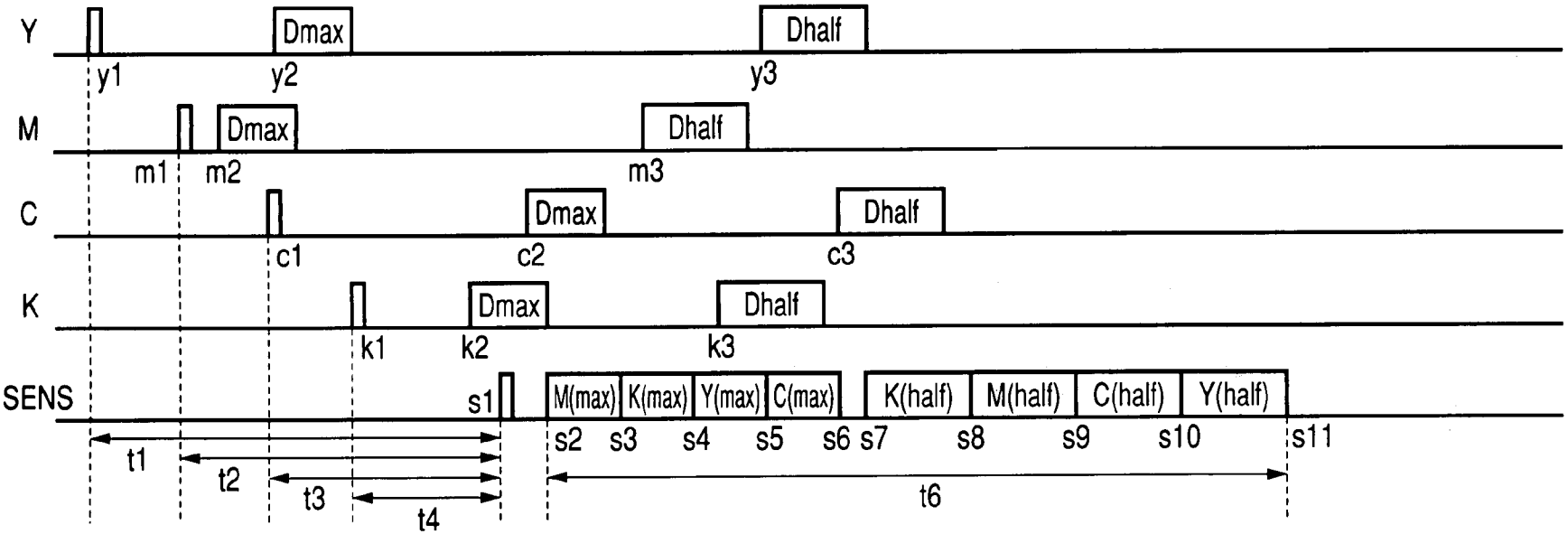
FIG. 7 is a timing diagram for explaining timings for forming and measuring the Dmax patch groups and the Dhalf patch groups in the image forming apparatus according to the first embodiment of the present invention.

Referring to FIG. 7, there is shown a sequence diagram for explaining patch formation and density measurement processing in an image forming apparatus according to the first embodiment of the present invention. In this regard, belt cleaning, base detection, and other processing are omitted, and mainly the characterizing parts of this embodiment such as timings and orders of the Dmax patch group formation and those of the Dhalf patch group formation will be described here. To simplify the description, it is assumed that there are settings of time "0" for changing the developing bias, CPU 110 processing time "0" for the Dmax calculation, and time "0" from a start of the image formation to an arrival of an electrostatic latent image at the developing part. Practically, these values cannot be "0" and differences in timing occur in the timing diagram. In relative comparisons with comparative examples described later, however, they do not damage effects of the present invention. Therefore, these settings have been used to simplify the description. In this embodiment, the periphery of the photosensitive drum and the ETB are moving at the same peripheral velocity. Only if the moving velocity is fixed, it is arbitrary, not particularly limited. While the horizontal axis of the timing diagram in FIG. 7 corresponds to an original time, the time axis can be directly converted into distance since the moving velocity is fixed. To simplify the description, specific numerical values of time differences in the timing diagram will be described in terms of distances here.

FIG. 7 shows the timings of yellow (Y), magenta (M), cyan (C), and black (K) image signals and detection timing of the density sensor (SENS) in this order from the top downwardly. In the same manner as for the normal printing, the first signal is issued at timing y1, m1, c1, or k1 to achieve appropriate write timing in each image forming station. By starting the image formation (latent image formation) in each station at the issue of the first signal, an image can be formed in the same position on the ETB 20. FIG. 7 also shows time s1 when the first position reaches a position detected by the density sensor 31. Differences between y1 and m1, m1 and c1, and c1 and k1 correspond to periods of time for moving the ETB 20 by distances substantially equal to station intervals Lst (=60 mm), and they are finely adjusted so as to achieve a registration by means of a known registration correction technology. Difference t1 between y1 and s1 indicates a time lag between the start of the patch image formation in the Y station and a reach of the patch at the position detected by the density sensor 31, and it corresponds to the foregoing 280-mm idle running distance. Similarly, t2 (220 mm), t3 (160 mm), and t4 (100 mm) indicate time lags in the M, C, and K stations, respectively.

In this embodiment, the Dmax patch groups are formed in succession in order of M, K, Y, and C on the ETB 20. The output SENS of the density sensor 31 corresponds to a result of measuring the patch groups in the order of M, K, Y, and C since the patches formed on the ETB 20 are sequentially read into it. In this diagram, s2 to s3, s3 to s4, s4 to s5, and s5 to s6 correspond to a magenta Dmax patch measuring period, a black Dmax patch measuring period, a yellow Dmax patch measuring period, and a cyan Dmax patch measuring period, respectively. Furthermore, s7 to s8, s8 to s9, s9 to s10, and s10 to s11 correspond to a black Dhalf patch measuring period, a magenta Dhalf patch measuring period, a cyan Dhalf patch measuring period, and a yellow Dhalf patch measuring period, respectively.

For this arrangement, the image formation in the Y station is started at time y2, which is t1 earlier than s4 when the yellow patch measurement starts. Similarly, the M station starts the image formation at time m2, which is t2 earlier than s2 when the magenta patch measurement starts, the C station starts the image formation at c2, which is t3 earlier than s5 when the cyan patch measurement starts, and the K station starts the image formation at k2, which is t4 earlier than s3 when the black patch measurement starts. Since reading of the magenta patch group completes at the time s3, the Dmax calculation on the magenta image formation can be started at s3. Unless the reading of the Dmax patch group completes, the Dmax control cannot be performed, by which a developing bias cannot be determined. Thus, the time m3 for starting the magenta Dhalf patch formation need be at the time s3 or later. Similarly, the Dmax calculation on the cyan image formation can be started at s6 and the Dmax calculation on the yellow image formation can be started at s5.

As a result of the present inventor's serious consideration, it was found that the patch groups can be arranged most closely without overlapping with each other by forming the Dhalf patch groups on the ETB 20 in the order of KMCY, which is different from the color order of the Dmax patch groups. Specifically, all the related numerical values represented by distances from the time s2 (in units of mm) are as follows:

s3=50, s4=100, s5=150, s6=200, s7=220, s8=290, s9=360, s10=430, s11=500, y3=150, m3=70, c3=200, k3=120.

The lengths of the Dmax patch groups are: s4−s3=s5−s4=s6−s5=Lmx=50. The lengths of the Dhalf patch groups are: s8−s7=s9−s8=s10−s9=s11−s10=Lhf=70. The yellow patch idle running distance is s10−y3=280. Similarly, the M, C, and K patch idle running distances are the same as the above description. Therefore, there is no inconsistency in timing. Furthermore, there are relations: s3<m3, s4<k3, s5=y3, and s6=c3, and thus the Dhalf patch group formation is started after or immediately after a completion of the Dmax patch groups of all stations.

The total length t6 of all patch groups can be s11−s2=500 mm by forming the Dmax patch groups in the MYKC station order on the ETB 20 and forming the Dhalf patch groups in the KMCY station order at the optimum timings for the formations. The length is 100 mm shorter than 600 mm, which is equivalent to a single round of the ETB 20.

Furthermore, the patch formation can be completed in the ETB 20 having a still shorter peripheral length, thereby enabling downsizing of the apparatus. Still further, when the Dmax and Dhalf controls are executed in succession, the processing can be completed only by moving the ETB 20 around four times since there is no need to perform cleaning during the execution.

In this manner, the patch group total length can be decreased by arranging the Dmax and Dhalf patch groups in the predetermined color orders in this embodiment.

In addition, the time for calibration can be reduced when the Dmax control and the Dhalf control are executed in succession, by forming the Dmax patch groups and the Dhalf patch groups on the ETB 20 movable around by using the predetermined color orders.

As mentioned above, the M and K stations have a little time to spare after measuring the Dmax patch group before forming the Dhalf patch group, and therefore the formation timing can be advanced further without overlapping with other patch groups. Note that, however, it does not lead to a decrease in the foregoing patch group total length since the patch formation in the Y station of the final color cannot be advanced in the Dhalf control.

Figure 10:
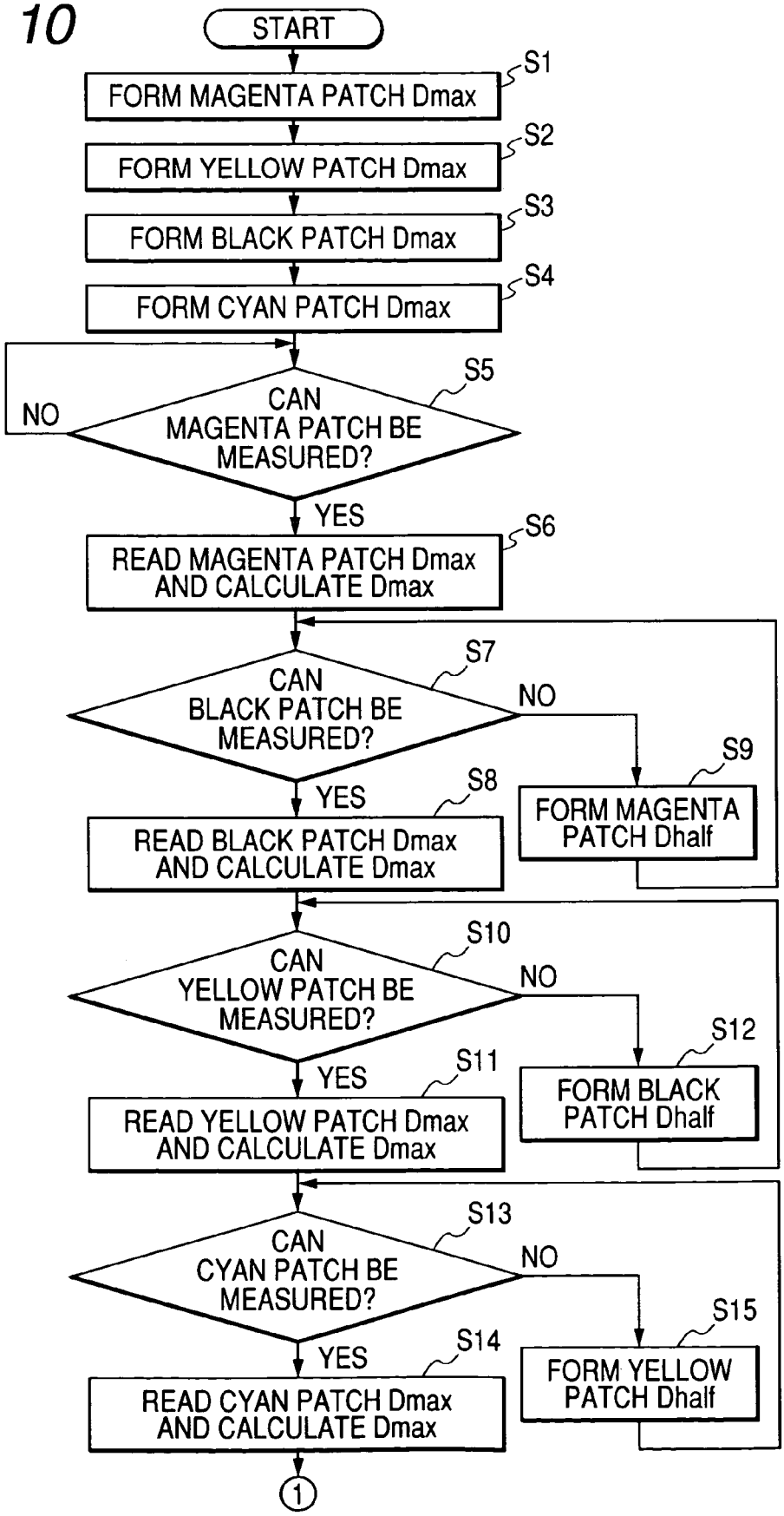
FIG. 10 is a flowchart for explaining processing of forming an measuring the Dmax patch groups and the Dhalf patch groups in the image forming apparatus according to the first embodiment.
Figure 11:
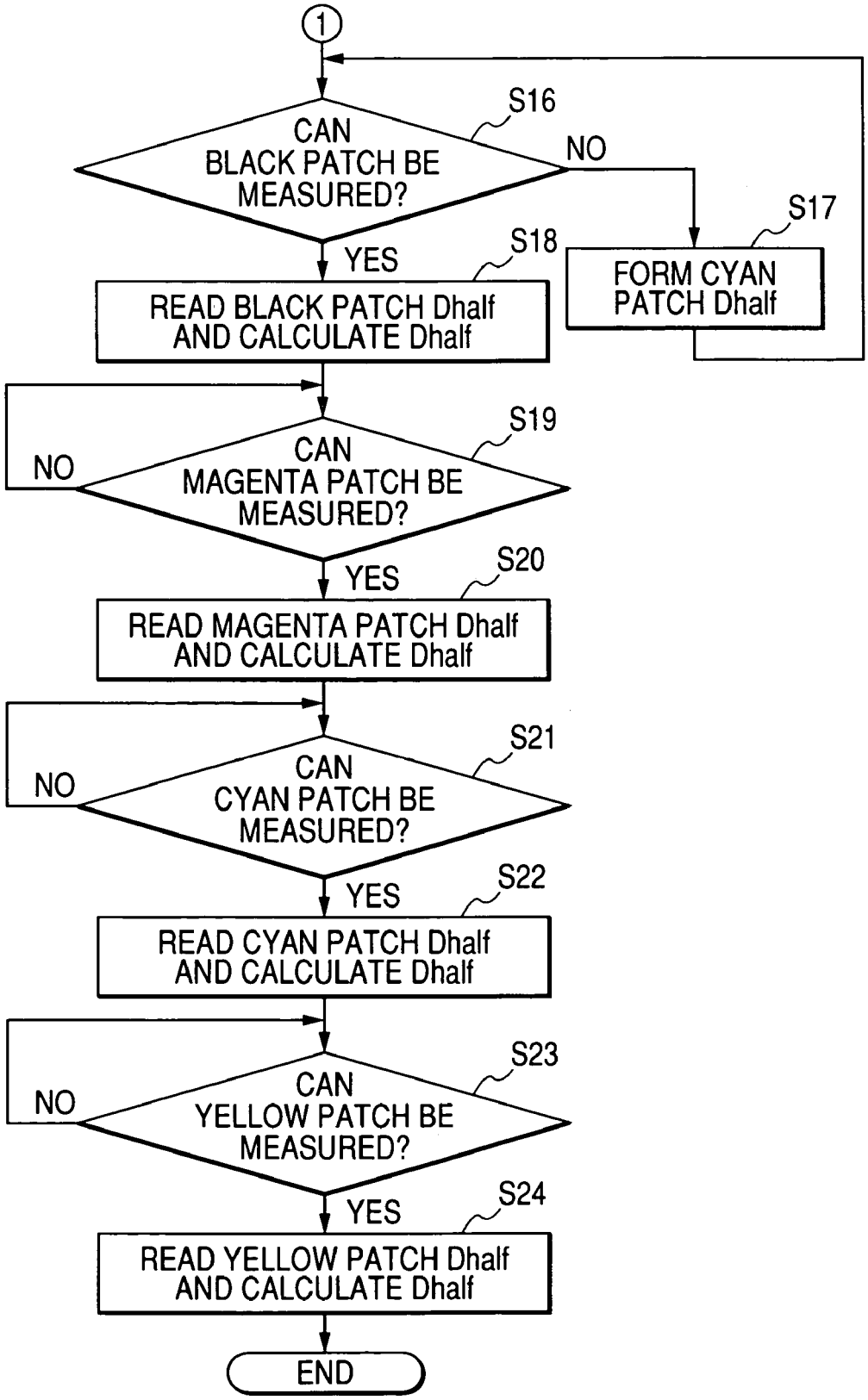
FIG. 11 is a flowchart for explaining processing of forming and measuring the Dmax patch groups and the Dhalf patch groups in the image forming apparatus according to the first embodiment.

Referring to FIGS. 10 and 11, there are shown flowcharts for explaining the Dmax and Dhalf control processing in the image forming apparatus according to this embodiment of the present invention. The ROM 111 stores a program for executing the processing and it is executed under the control of the CPU 110. The flowcharts are based on the timing diagram shown in FIG. 7.

With an instruction of starting the Dmax and Dhalf control processing, the ETB 20 is cleaned and its base is measured, and then the control progresses to this processing flowchart. First, a head signal is issued to achieve an exact timing for writing in each image forming station. At the exact timing in line with the head signal, the image formation (latent image formation) in each station is started. First, in step S1, a magenta Dmax patch is formed here. Then, a yellow Dmax patch is formed in step S2, a black Dmax patch is formed in step S3, and a cyan Dmax patch is formed in step S4. The ROM 111 stores pattern data (See FIG. 4) for forming the Dmax patches of these colors. Although the patch groups of these colors need not be formed at the timings shown in FIG. 7 necessarily, the patch color orders should conform to those in FIG. 7 as a rule.

After the Dmax patches of four colors are formed on the ETB 20 in this way, the control progresses to step S5, where it is determined whether the magenta Dmax patch formed first has reached the position for a measurement with the density sensor 31. If so, the control progresses to step S6, where the magenta Dmax patch density is measured and the Dmax calculation is executed on the magenta image formation. This determines a developing bias in the M station.

Subsequently, the control progresses to step S7, where it is determined whether the black Dmax patch formed in the K station, which is the nearest station to the density sensor 31, is ready for measurement with the density sensor 31. At this point, the magenta developing bias has been determined and therefore a magenta Dhalf patch can be formed by the magenta station in step S9 before measuring the black Dmax patch density. Thus, when the black Dmax patch reaches the position for measurement with the density sensor 31, the black Dmax patch density is measured in step S8 and the Dmax calculation is executed to determine a developing bias in the black station.

Subsequently, the control progresses to step S10, where it is determined whether the yellow Dmax patch having been formed second is ready for measurement with the density sensor 31. At this point, the black developing bias has been determined and therefore a black Dhalf patch can be formed by the black station in step S12 before measuring the yellow Dmax patch density. Thus, when the yellow Dmax patch reaches the position for measurement with the density sensor 31, the yellow Dmax patch density is measured in step S11 and the Dmax calculation is executed to determine a developing bias in the yellow station.

For the next station, similarly it is determined whether the cyan Dmax patch formed last is ready for measurement with the density sensor 31 in step S13. At this point, the yellow developing bias has been determined and therefore a yellow Dhalf patch can be formed by the yellow station in step S15 before measuring the cyan Dmax patch density. Thus, when the cyan Dmax patch reaches the position for measurement with the density sensor 31, the cyan Dmax patch density is measured in step S14 and the Dmax calculation is executed to determine a developing bias in the cyan station.

Subsequently, the control progresses to step S16, where it is determined whether the black Dhalf patch having been formed in the black station, which is the nearest station to the density sensor 31, is ready for measurement with the density sensor 31. At this point, the cyan developing bias has been determined and therefore a cyan Dhalf patch can be formed by the cyan station in step S17 before measuring the black Dhalf patch density. Thus, when the black Dhalf patch reaches the position for measurement with the density sensor 31, the black Dhalf patch density is measured in step S18 and the Dhalf control is executed. In this embodiment, the density sensor 31 detects the density patches of a plurality of densities and obtains a relation between the image signal for generating the Dhalf patch and the density of the actually formed patch. Thereafter, correction data is obtained for correcting a black image signal practically input from the host computer or the like so as to reproduce a desired density based on the relation. The Dhalf control is executed in the same manner as for other colors in the subsequent processing.

Subsequently, in step S19, it is determined whether the magenta Dhalf patch, which has been formed first among the Dhalf patches, has reached the position where its density can be detected by the density sensor 31. If it has reached the position, the magenta Dhalf patch density is measured in step S20 and the magenta Dhalf control is executed. Subsequently, in step S21, it is determined whether the Dhalf patch formed in the cyan station, which is the second nearest station to the density sensor 31 after the black station, has reached the position where its density can be measured by the density sensor 31. When it comes to the position that can be detected by the density sensor 31, the cyan Dhalf patch density is measured and the cyan Dhalf control is executed in step S22. Finally, in step S23, it is determined whether the yellow Dhalf patch formed in the yellow station, which is the most distant station from the density sensor 31, has reached the position where its density can be detected by the density sensor 31. When it comes to the position, the density of the yellow Dhalf patch is measured and the yellow Dhalf control is executed in step S24. This determines the developing bias and the image processing method for the stations of all colors, Y, M, C, and K.

The effects of the first embodiment will be further apparent from a comparison with comparative example 1 described below.

COMPARATIVE EXAMPLE 1

Figure 8:
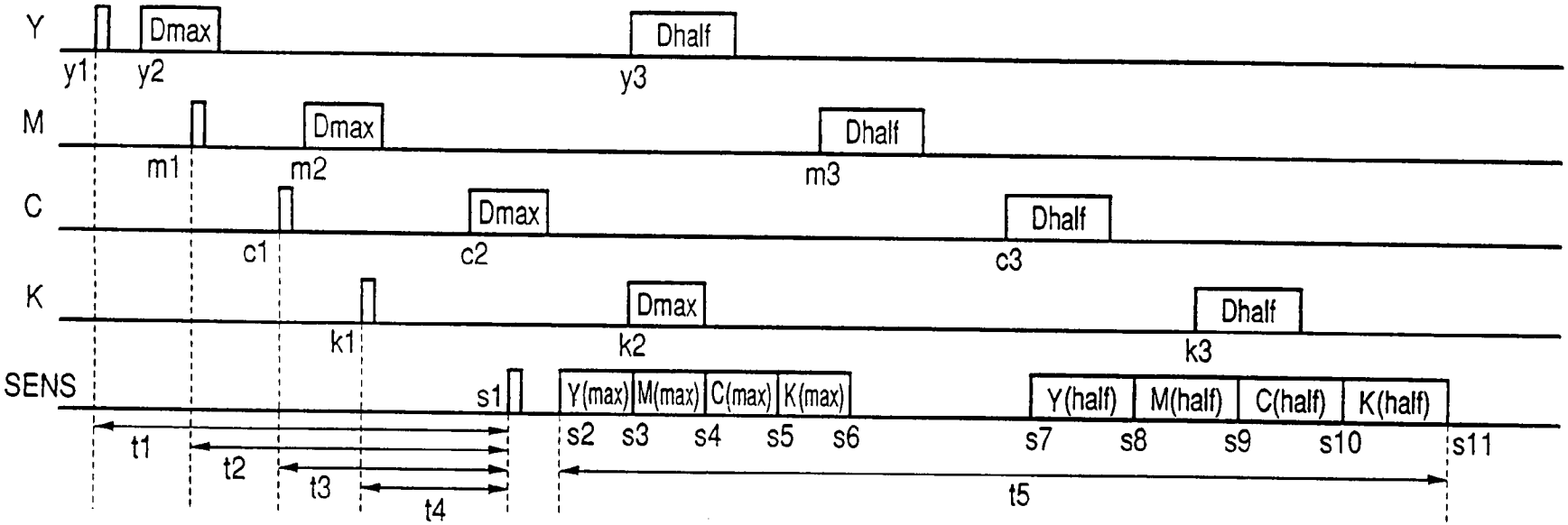
FIG. 8 is a timing diagram for explaining comparative example 1 to be compared with the first embodiment.

Referring to FIG. 8, there is shown a sequence diagram for explaining the comparative example 1 with the above first embodiment.

In FIG. 8, the order of the stations forming the Dmax patch groups and the Dhalf patch groups only differs from that of the first embodiment stated above, and the image forming apparatus in this image formation is the same as the first embodiment and the required idle running distances and the like are the same as the first embodiment, too.

In the comparative example 1, the Dmax patch groups are formed in the order of YMCK on the ETB 20. This order is the same as the physical arrangement order of the image forming stations and it has been frequently used in the conventional Dmax control. Similarly, the Dhalf patch groups are formed in the order of YMCK in the same manner as the arrangement order of the image forming stations on the ETB 20. Similarly to the first embodiment, the patch groups are arranged without overlapping with adjacent patch groups and at the minimum intervals. Specifically, the related numerical values represented by distances from the time s2 (in units of mm) are as follows: s3=50, s4=100, s5=150, s6=200, s7=330, s8=400, s9=470, s10=540, s11=610, y3=50, m3=180, c3=310, k3=440.

The lengths of the Dmax patch groups are: s4−s3=s5−s4=s6−s5=Lmx=50. The lengths of the Dhalf patch groups are: s8−s7=s9−s8=s10−s9=s11−s10=Lhf=70. The yellow patch idle running distance is s10−y3=280. Similarly, the M, C, and K patch idle running distances are the same as those in the first embodiment.

Furthermore, there are relations: s3=y3, s4<m3, s5<c3, and s6<k3. While the Y station starts a Dhalf patch formation immediately after measuring the Dmax patch group, other stations have a waiting time for the Dhalf patch formation of the previous station after measuring the Dmax patch group. Therefore, the rearward station has a longer waiting time. Thus, if the Dmax patch groups are formed in the order of YMCK stations on the ETB 20 and the Dhalf patch groups are also formed in the order of YMCK stations, the total length t5 of all patch groups is s11−s2=610 mm. Thus, it is 10 mm longer than the length 600 mm of a single round of the ETB 20. Therefore, the rear end of the black (K) Dhalf patch group overlaps with the front end of the yellow (Y) Dmax patch group having moved around on the ETB 20, and thereby a true result of the measurement cannot be obtained. Therefore, there is a need for executing the patch formation in two rounds or for increasing the peripheral length of the ETB 20. If the Dmax control and the Dhalf control are executed in two rounds of the ETB 20, undesirably the time for calibration increases as stated above.

While the increase in the peripheral length of the ETB 20 prevents an increase in the time for calibration, it undesirably leads to an increase in size of the apparatus.

As stated above, the patch group total length can be decreased by modifying the color order of the Dmax and Dhalf patch groups. It produces an effect of keeping the patch group total length within the predetermined distance.

COMPARATIVE EXAMPLE 2

For example, Japanese Patent Application Laid-Open No. 2002-139877 discloses a method of forming patch groups in the order of KCMY stations with a view to reducing the time from the patch formation to the patch density detection.

Figure 9:
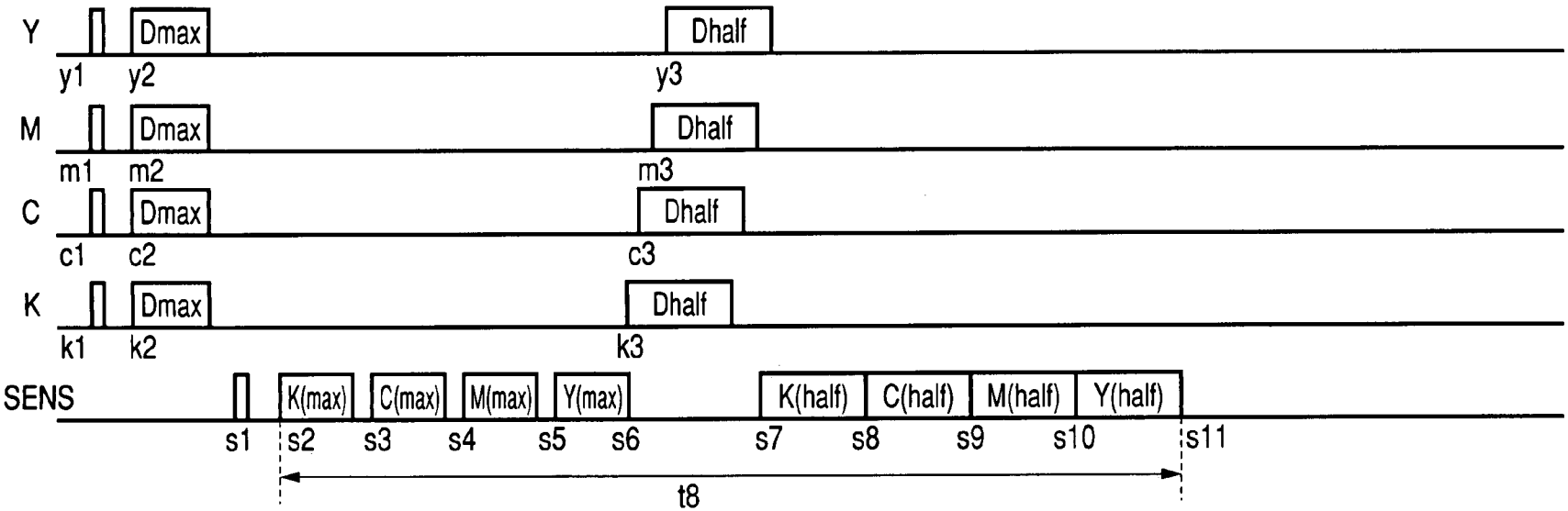
FIG. 9 is a timing diagram for explaining comparative example 2 to be compared with the first embodiment and is a diagram for explaining another embodiment of the present invention.

Referring to FIG. 9, there is shown a diagram for explaining the method disclosed in the gazette, showing a timing diagram in which the patch groups are formed. The station arrangement of the image forming apparatus in this example is also the same as that of the first embodiment and the required idle running distances are the same as the above, too. Note that, however, a Dmax patch formation start signal is issued to all stations at a time before the Dmax patch formation.

In the comparative example 2, the Dmax patch groups are formed in the order of KCMY on the ETB 20. The Dhalf patch groups are similarly formed in the order of KCMY on the ETB 20. Then, as conventional, the Dmax calculation is executed after reading all the Dmax patch groups of all image forming stations and thereafter the Dhalf patch groups formation is started. Numerical values related to timings of the comparative example 2 represented by distances from the time s2 (in units of mm) are as follows: s3=60, s4=120, s5=180, s6=240, s7=340, s8=410, s9=480, s10=550, s11=620, y3=270, m3=260, c3=250, k3=240.

In this regard, the idle running distance of a Y patch is s10−y3=280. The M, C, and K idle running distances are also the same as those in the first embodiment. In this manner, the Dmax patch groups are formed in the order of KCMY stations on the ETB 20, the Dmax calculation is performed after reading the Dmax patch groups of all the image forming stations, and then the Dhalf patch groups are also formed in the order of KCMY stations on the ETB 20. This causes the total length t8 of all the patch groups is s11−s2=620 mm, which is 20 mm longer than 600 mm, which is the length of a single round of the ETB 20. Thereby, the rear end of the black (K) Dhalf patch group overlaps with the front end of the yellow (Y) Dmax patch group having moved around on the ETB 20 similarly to the comparative example 1. Thereby, a true result of the measurement cannot be obtained.

As stated above, in the comparative example 2, the image formation start signal is output to the stations simultaneously and a patch formation starts from the nearest station (K) to the density sensor 31. Thereby, the required time from the output of the patch formation start signal to the end of the Dhalf patch group measurement is shorter than the first embodiment. It, however, does not mean that the patch groups are always efficiently arranged on the ETB 20.

Second Embodiment

The following describes an embodiment in which the patch group total length can be shorter than that of the comparative example 1 when using color orders other than those of the first embodiment.

Referring to FIGS. 12A, 12B, 12C and 12D, there is shown a diagram for explaining the color orders according to the second embodiment.

In FIGS. 12A, 12B, 12C and 12D, "Dmax station order" represents a station order in forming the Dmax patch groups. For example, representation "1234" indicates that the Dmax patch groups are formed on the ETB 20 in the order of the first station (Y), the second station (M), the third station (C), and the fourth station (K). Similarly, "Dhalf station order" represents a station order in forming the Dhalf patch groups. "Dmax color order" and "Dhalf color order" represent the order of the Dmax control and the order of the Dhalf control in an image forming apparatus according to this embodiment by means of colors: the station order "1234" corresponds to YMCK. "Color order variation" represents a variation of each station patch formation order between Dmax and Dhalf: a positive value indicates a fall in the order and a negative value indicates a rise in the order. Specifically, by way of example of the first embodiment, Y is third in the Dmax control, but it is down to fourth in the Dhalf control, and therefore its value is "1." Furthermore, while M is first in the Dmax control, it is down to second in the Dhalf control and therefore its value is "1," too. On the other hand, C is fourth in the Dmax control and it rises to third in the Dhalf control, and therefore its value is "−1." K is second in the Dmax control and rises to first in the Dhalf control, and therefore its value is "−1." "Patch group total length" represents a total length of the Dmax and Dhalf patch groups arranged as closely as possible in the corresponding orders. As this value gets smaller, the ETB 20 can be shorter or the number of patches can be increased preferably.

When the same color order is used for the Dmax patch groups and the Dhalf patch groups in the comparative example 1, an obstacle to shortening the "patch group total length" is a time lag of the first station (Y). Specifically, it is preferable to adopt a basic policy of the color order arrangement such that the stations on the upstream side having a relatively long time lag are arranged so that processing of other stations can be performed during the time lag and the stations on the downstream side having a relatively short time lag are arranged so that processing of other stations cannot be performed. In other words, for the first half of the plurality of image forming stations, the Dhalf formation order should be the same as or lower than the Dmax formation order. For the second half of the image forming stations, the Dhalf formation order should be the same as or higher than the Dmax formation order (condition 1).

If the patch formation of the first station (Y) is executed first in both Dmax and Dhalf, the patch total length is the same as in the comparative example 1. Therefore, it is preferable to exclude the above case (condition 2).

Furthermore, it is found that, if patches of the third station (C) are formed fourth in Dmax and formed first in Dhalf, they are too close to each other and a longer time lag than the comparative example 1 is required in some cases. In these cases, preferably an increase in the patch formation order in the third station (C) is "2" or less to move them slightly farther apart from each other (condition 3).

FIGS. 12A, 12B, 12C and 12D, show examples satisfying the above condition 1 in which the first half of the image forming stations, namely, the fist station (Y) and the second station (M) have the "color order variation" of "0" to "3" and the third station (C) and the fourth station (K) have the "color order variation" of "0" to "−3." In the second embodiment, the third station (C) has the order variation of "−2" or higher in all cases and both the condition 2 and the condition 3 are satisfied. In other words, only if the color order satisfies all of the above conditions 1 to 3, it is always possible to make the patch group total length shorter than the comparative examples.

Figure 13:
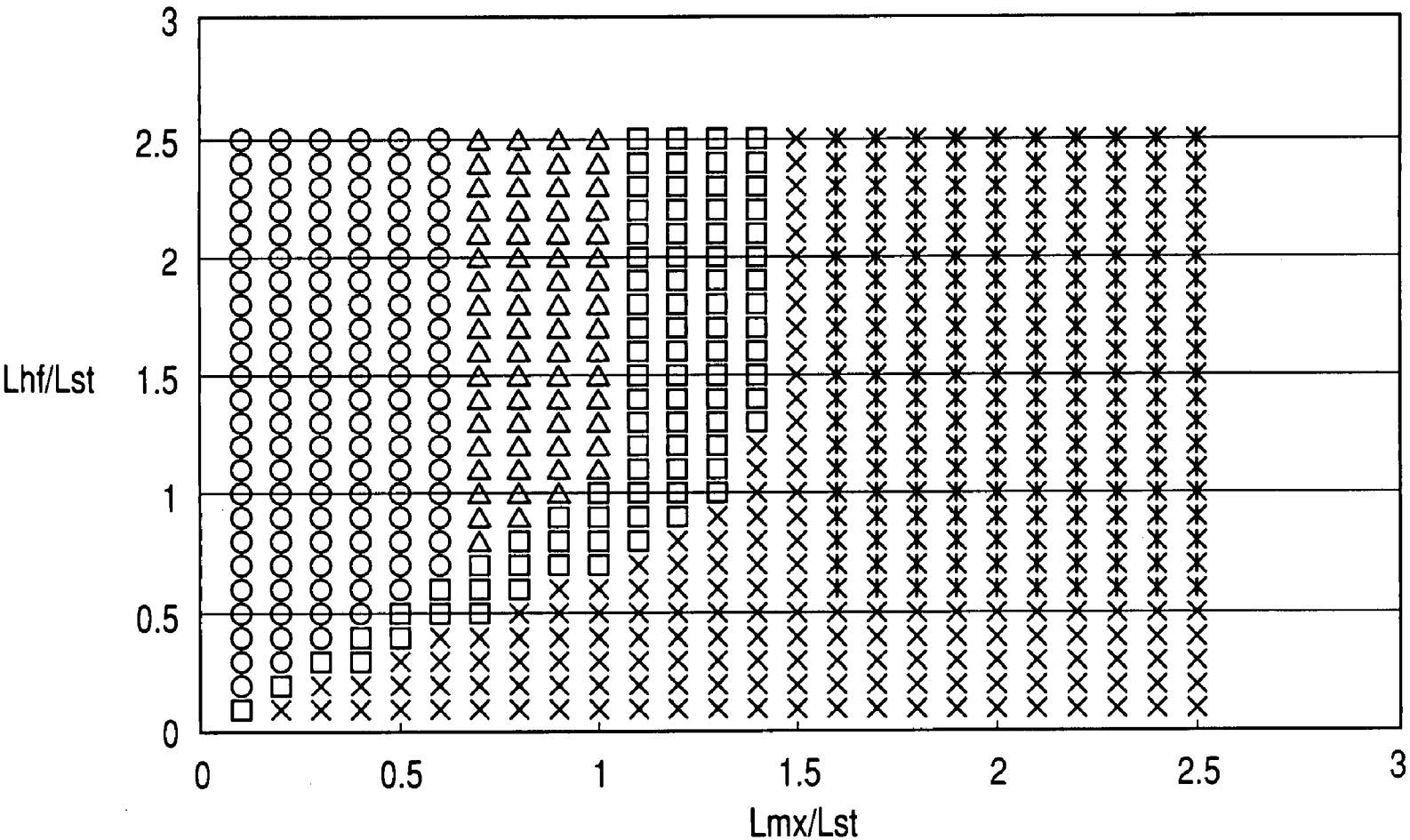
FIG. 13 is a diagram for explaining variations in a total length of the patch groups according to the color order of the second embodiment of the present invention.

FIG. 13 shows the situation, where: an interval between stations Lst=60 mm; a sum of a distance Ltr from a developing roller to a transferring position on a photosensitive drum and a distance Lsens from a transferring position of the fourth station to the density sensor 31, in other words, Ltr+Lsens=100 mm; a total length of the Dmax patch group per color Lmx=50 mm; and the total length of the Dhalf patch group per color Lhf=70 mm. The time lag depends upon the values of Lst, Ltr, Lsens, Lmx, and Lhf and the color order in which the patch groups can be arranged most closely also varies according to them. It is difficult to provide a universal rule of the ideal color order for four unknowns. Therefore, we suggest a rule useful within a practical range of each parameter.

For the ETB 20 to move around all the stations, at least 3×Lst in one side or 6×Lst in the peripheral length is necessary, even if the diameter of the tension roller 24 and the diameter of the drive roller 30 are vanishingly small. The peripheral length of the ETB 20 in a normal image forming apparatus having four image forming stations is about 10 times the length Lst. Therefore, if it is 20 times or more the length Lst, the body of the image forming apparatus is excessively large and it is not preferable. To form the patch groups eight times in total (4 colors×2 times (Dmax and Dhalf)) within a single round of the ETB 20, it is preferable to keep (Lmx+Lhf) at five or less times the length Lst at the most. Considering that a margin is to be allowed for an effect on the size of the body of the image forming apparatus, a calculation time, a manufacturing variation of the peripheral length of the ETB 20, an environmental variation, and an endurance variation, 2.5 or less times the length Lst is preferable. Thus, it is practical to keep both Lmx and Lhf within 2.5 or less times the length Lst.

Referring to FIG. 13, there is shown a diagram for explaining the color orders in which the patch groups are arranged more closely than the comparative example 1 when the values are varied within the above range.

Here, Lsens+Ltr=(5/3)×Lst is assumed. Lmx and Lhf are varied up to 2.5 times the length Lst at 0.1 intervals. Then, it is considered what rule is applicable to setting the color orders of Dmax and Dhalf to achieve the total length of the patch groups shorter than that of the comparative example 1 stated above, regarding all the color orders of (41) 2=576. Only if the color order satisfies the above conditions 1 and 2, the patch group total length can be shorter than that of the color order in the comparative example 1 in any area marked with a circle in FIG. 13. In the area marked with the circle, namely, when Lmx<(2/3)×Lst and Lhf>Lm are satisfied, the Dhalf patch formation order should be the same as or lower than the Dmax patch formation order in the first half of the stations, while the Dmax patch formation order should be the same as or higher in the second half of the stations.

In other words, let j×k≠1 when i=1, where the patch formed by the i-th station has the j-th color order in the first test patch group and the k-th color order in the second test patch group. This decreases the patch group total length. The above j×k≠1 is a numerical formula representing the condition 2. If the color order satisfies the above conditions 1 to 3, the patch group total length can be shorter than that of the color order in the comparative example 1 also in any area marked with a triangle in addition to the areas marked with the circle in FIG. 13. In other words, the patch group total length is decreased by using an arrangement in which j×k≠1 when i=1 and 0≦j−k≦2 when i=3 where Lmx<Lst and Lhf>Lmx and in which the Dhalf patch formation order is the same as or lower than the Dmax patch formation order in the first half of the stations and the Dhalf patch formation order is the same as or higher than the Dmax patch formation order in the second half of the stations.

If the foregoing color orders satisfying the above condition 1 are arranged in the order of their patch group total length, shortest first, the color orders conforming to the following rule rank in the upper half of the color orders. The rule is that, during the Dmax and Dhalf controls of the first station, four or more patch groups of other stations are arranged: three or more for the second station, two or more for the third station, and one or more for the fourth station. It is found that the patches can be closely arranged in such a color order that a distance between the Dmax and Dhalf patches varies as in an arithmetic sequence relative to the stations since a time lag between the stations varies in an arithmetic sequence with a common difference Lst. In other words, if a Dmax patch is formed in the i-th image forming station and then (5-i) or more patch groups are inserted before the Dhalf patch formation (hereinafter, referred to as condition 4) and the foregoing condition 1 is satisfied in the color order, it is found that the patch group total length can be shorter than the comparative example 1 in any area marked with a square, in addition to the foregoing areas marked with the circle and with the triangle.

This method decreases the patch group total length by using an arrangement in which k≧j−i+2 when Lmx<(3/2)×Lst and Lhf>Lmx and in which the Dhalf patch formation order is the same as or lower than the Dmax patch formation order in the first half of the stations and the Dhalf patch formation order is the same as or higher than the Dmax patch formation order in the second half of the stations. The above k≧j−i+2 is a numerical formula representing the condition 4.

In FIG. 13, a patch group total length varies with a color order in an area marked with a cross. Although the patch group total length may be shorter than that of the comparative example in some cases, the rule for the color order causing a superior result could not be clarified in the areas marked with the cross. An asterisk indicates an area in which the color order of the comparative example 1 is used and the Dmax and Dhalf patch groups can be arranged without a margin and therefore any other design is unnecessary since adjacent patch groups overlap with each other if the patch groups are arranged more closely. The area marked with the asterisk increases as (Lsens+Ltr) becomes shorter (the position of the density sensor 31 approaches the fourth station), while the areas marked with the circle, triangle, and square do not depend upon the magnitude of (Lsens+Ltr). The enlarged area marked with the asterisk gets filled in. In this case, the patch group total length is the same as, not inferior to, that in the foregoing comparative example 1. Therefore, by using the color order satisfying the above conditions, a combination having the shorter patch group total length can be selected out of the combinations of the color orders, independently of the (Lsens+Ltr) value.

OTHER EMBODIMENTS

While the developing bias is varied in the test patch formation in the Dmax control in the above description, the varied density control factor is not limited thereto, but the foregoing Ltr may be appropriately varied for the corresponding position according to an element to be varied.

In addition, while the embodiment has been described by giving an example that the image forming stations are arranged in the order of YMCK, the color order of the embodiment indicates the order of the image forming stations and the present invention is not limited to the arrangement.

While the above embodiment has been described by giving an example that test patches are formed on a belt, which is an intermediate transferring member, it is also possible to form the first and second test patch groups on the same recording medium by forming test patches in the first color order on paper or other recording medium and forming test patches in the second color order under a different image forming condition and to perform the same controls as for the above embodiment based on the densities.

Furthermore, an embodiment of the color order may be the same as the above embodiment only if the density sensor is disposed in a position where it can measure the patch groups on the recording medium.

As set forth hereinabove, according to the embodiments, calibration can be executed with the minimum use of the recording medium, which is a user resource, thus reducing a user's load.

The method of forming an image using image forming stations is not limited to the nonmagnetic one-component contact development, but can be non-contact development, two-component development, or wet development, and can be a method other than an electrophotographic method, namely, a solid-ink or toner-jet method.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

This application claims priority from Japanese Patent Application No. 2003-425825 filed Dec. 22, 2003, which is hereby incorporated by reference herein.

What is claimed is:

1. An image forming apparatus, comprising:

a plurality of image forming parts;

a moving medium continuously moving on said plurality of image forming parts according to an arrangement of color orders of the plurality of image forming parts;

first test image forming means for forming a first test image on the moving medium by using the plurality of image forming parts in a first color order;

density measuring means for measuring a density of the test image formed on the moving medium;

second test image forming means for forming a second test image on the moving medium by setting a first image forming condition in a corresponding image forming part based on a result of measuring a density of the first test image using the density measuring means and by using the corresponding image forming pan based on the first image forming condition in a second color order; and control means for controlling image forming processing in the plurality of image forming parts according to the first and second image forming conditions by setting a second image forming condition in each of the plurality of image forming parts based on a result of measuring a density of the second test image using the density measuring means, wherein the first test image and the second test image are formed within predetermined dimensions by applying specific color orders to the first and second color orders, respectively; and wherein the plurality of image forming parts form images having different colors from each other and a color order of formed color images differs between the first test image and the second test image.

2. An image forming apparatus according to claim 1, wherein said moving medium is a cyclically moving belt and the first and second test images are formed within a single round of the cyclically moving belt.

3. An image forming apparatus according to claim 1, wherein said moving medium is a recording medium and the first and second test images are formed within a length of the recording medium in a moving direction.

4. An image forming apparatus according to claim 1, wherein the first test image is for use in acquiring an image forming condition for attaining an image having a highest density formed at a predetermined density and the second test image is formed with a plurality of densities and for use in correcting a relation between a density of an image signal and the density of the formed image.

5. An image forming apparatus according to claim 1, wherein a position in the color order of the second test image is the same as or behind a position in the color order of the first test image for a first half of the plurality of image forming parts viewed from an upstream side in the moving direction of the moving medium and a position in the color order of the second test image is the same as or ahead of a position in the color order of the first test image for a second half of the plurality of image forming parts.

6. An image forming apparatus according to claim 5, wherein, if a quantity of the plurality of image forming parts is defined as 4, j is the color order in the first test image formed by an image forming part arranged at an i-th position on a downstream side in the moving direction of the moving medium, k is the color order in the second test image, Lmx is a total length per color of the first test image, Lst is an interval between the image forming parts, and Lhf is a total length per color of the second test image, they satisfy the following:

$j \times k \neq 1$;

$Lmx < (2/3) \times Lst$; and $Lhf > Lmx$ where $i = 1$.

7. An image forming apparatus according to claim 6, wherein the representations i, k, j, Lmx, Lhf, and Lst satisfy the following:

$k \geqq j-i+2$;

$Lmx<(3/2)\times Lst$; and $Lhf>Lmx$.

8. An image forming apparatus according to claim 6, wherein the representations i, k, j, Lmx, Lhf, and Lst satisfy the following:

$j\times k\neq 1$ where $i=1$;

$0\leqq j-k\leqq 2$ where $i=3$;

$Lmx<Lst$; and $Lhf>Lmx$.

9. An image forming apparatus, comprising:

a plurality of image forming parts;

a moving medium continuously moving on the plurality of image forming parts according to an arrangement of color orders of the plurality of image forming parts;

first test image forming means for forming a first test image on the moving medium for each image forming part by using the plurality of image forming parts in a first color order;

density measuring means for measuring a density of each test image formed on the moving medium in a rear stage of the plurality of image forming parts;

second test image forming means for forming a second test image on the moving medium by setting a first image forming condition in the image forming parts having formed the first test image by executing a highest density image calculation based on a result of measuring the density of the first test image using the density measuring means and by using the image forming parts based on the first image forming condition for the second color order; and control means for controlling image forming processing in the plurality of image forming parts according to the first and second image forming conditions by setting a second image forming condition in the plurality of image forming parts by executing a halftone image density calculation based on a result of measuring the density of the second test image using the density measuring means, wherein the first test image and the second test image are formed within predetermined dimensions by applying different color orders to the first and second color orders, respectively orders.

10. An image forming control method in an image forming apparatus having a plurality of image forming parts and forming an image on a moving medium continuously moving on the plurality of image forming parts according to an arrangement of color orders of the plurality of image forming parts, comprising the steps of:

forming a first test image on the moving medium by using the plurality of image forming parts in a first color order;

measuring a density of the test image formed on the moving medium in said step of forming a first test image on the moving medium;

setting a first image forming condition in a corresponding image forming part based on a result of measuring the density of the first test image in said step of measuring a density of the first test image;

forming a second test image on the moving medium by using the corresponding image forming part in a second color order based on the first image forming condition;

measuring a density of the second test image formed on the moving medium in said step of forming a second test image on the moving medium;

setting a second image forming condition in each of the plurality of image forming parts based on a result of said step of measuring the density of the second test image; and controlling image forming processing in the plurality of image forming parts according to the first and second image forming conditions, wherein the first test image and the second test image are formed within specific dimensions by applying different color orders to the first and second color orders, respectively.

11. An image forming control method according to claim 10, wherein the first test image is for use in acquiring an image forming condition for attaining an image having a highest density formed at a predetermined density and the second test image is formed with a plurality of densities and for use in correcting a relation between a density of an image signal and the density of the formed image.

12. An image forming control method according to claim 10, wherein the moving medium is a cyclically moving belt and the first and second test images are formed within a single round of the cyclically moving belt.

13. An image forming control method according to claim 10, wherein the moving medium is a recording medium and the first and second test images are formed within a length of the recording medium in a moving direction.

14. An image forming control method according to claim 10, wherein the plurality of image forming parts form images having different colors from each other and a color order of formed color images differs between the first test image and the second test image.

* * * * *

UNITED STATES PATENT AND TRADEMARK OFFICE

CERTIFICATE OF CORRECTION

PATENT NO. : 7,221,882 B2
APPLICATION NO. : 11/014784
DATED : May 22, 2007
INVENTOR(S) : Ken Nakagawa It is certified that error appears in the above-identified patent and that said Letters Patent is hereby corrected as shown below:

COLUMN 1
Line 56, “one” should be deleted.

COLUMN 2
Line 5, “have” should read --has-- and “the” (third occurrence) should be deleted.

COLUMN 3
Line 44, “an” should read --and--;
Line 64, “cross” should read --cross---.

COLUMN 8
Line 32, “to 6” should read --too--.

COLUMN 18
Line 2, “(41) 2=576.” should read --(4 !)2=576--.

COLUMN 20
Line 12, “pan” should read --part--.

COLUMN 21
Line 50, “respectively orders.” should read --respectively.--.

Signed and Sealed this

Twenty-fifth Day of March, 2008

JON W. DUDAS
*Director of the United States Patent and Trademark Office*